US006609709B2

(12) United States Patent
Takahashi et al.

(10) Patent No.: US 6,609,709 B2
(45) Date of Patent: Aug. 26, 2003

(54) SHEET MEMBER FEEDING DEVICE, RECORDING APPARATUS EMPLOYING THE SAME AND IMAGE PICK-UP APPARATUS WITH RECORDING MECHANISM

(75) Inventors: Keiji Takahashi, Tokyo (JP); Katsumi Munenaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,376

(22) Filed: Sep. 7, 2001

(65) Prior Publication Data

US 2002/0033870 A1 Mar. 21, 2002

(30) Foreign Application Priority Data

Sep. 12, 2000 (JP) ..... 2000-277330

(51) Int. Cl.[7] ..... B41J 2/175

(52) U.S. Cl. ..... 271/115; 271/258.01; 271/258.05; 101/141; 101/142

(58) Field of Search ..... 271/109, 114, 271/115, 258.01, 258.05; 101/141, 142

(56) References Cited

U.S. PATENT DOCUMENTS 3,871,645 A * 3/1975 Buttner et al. ..... 271/270
4,589,646 A * 5/1986 Ozawa et al. ..... 271/4.04
4,825,762 A * 5/1989 Fischer ..... 101/142
4,866,531 A * 9/1989 Kobori et al. ..... 358/400
4,936,695 A * 6/1990 Ishii ..... 400/605
4,976,557 A * 12/1990 Uchikata ..... 400/565
5,117,246 A 5/1992 Takahashi et al. ..... 354/202
5,335,597 A * 8/1994 Helmstadter ..... 101/485
5,529,414 A * 6/1996 Katano et al. ..... 400/636.2
6,135,442 A * 10/2000 Hirata et al. ..... 271/116

FOREIGN PATENT DOCUMENTS

JP 1-145936 * 6/1989

* cited by examiner

*Primary Examiner*—Patrick Mackey
(74) *Attorney, Agent, or Firm*—Fitzpatrick, Cella, Harper & Scinto

(57) ABSTRACT

A sheet member feeding device comprises a first gear transmitting a driving force to a feeding roller for intermittently feeding a sheet member per a predetermined feeding amount, a second gear having a first mark and a second mark representative of a maximum eccentric position and a minimum eccentric position along a radial direction relative to a predetermined concentric circle in a tooth space, in opposition to each other and directly or indirectly transmitting a driving force to the first gear, a third gear directly or indirectly transmitting driving force from driving means to the second gear, detecting means for detecting the first mark and the second mark in the second gear and transmitting a detection output, and a control portion operating the driving means for performing operation for rotating the second gear through 180° between the first mark and the second mark with respect to feeding for a feeding amount of the sheet member for one time, on the basis of the detection output from the detecting means.

12 Claims, 30 Drawing Sheets

| GEAR | GEAR DATA | | | SPEED REDUCTION RATIO | ROTATION ANGLE PER ONE FEED | ERROR STANDARDIZED VALUE IN MESHING | | PITCH CIRCLE | | | RATIO OF ECCENTRIC AMOUNT RELATIVE TO PITCH CIRCLE DIAMETER |
|---|---|---|---|---|---|---|---|---|---|---|---|
| SIGN | Z | m | SHIFTING AMOUNT | | | ONE PITCH | TOTAL PITCH | DIAMETER | RUN OUT | ECCENTRIC AMOUNT | |
| | | | | | deg | μm | μm | mm | μm | μm | % |
| A | 12 | 0.1 | 0.05 | 1.0 | 1440.00 | 5.0 | 13.0 | 1.2 | 8.00 | 4.00 | 0.333 |
| B-1 | 96 | 0.1 | 0.00 | 8.0 | 180.00 | 5.6 | 16.0 | 9.6 | 10.40 | 5.20 | 0.054 |
| B-2 | 13 | 0.1 | 0.05 | 8.0 | 180.00 | 5.0 | 13.0 | 1.3 | 8.00 | 4.00 | 0.308 |
| C | 110 | 0.1 | 0.00 | 67.7 | 21.27 | 5.6 | 16.0 | 11.0 | 10.40 | 5.20 | 0.047 |
| D | 130 | 0.1 | 0.00 | 80.0 | 18.00 | 6.3 | 18.0 | 13.0 | 11.70 | 5.85 | 0.045 |

FIG.20

| FEED NO. | ROTATION ANGLE IDEAL VALUE | MOVING DISTANCE IDEAL VALUE | ROTATION ANGLE ACTUAL VALUE | MOVING DISTANCE ACTUAL VALUE | ROTATION ANGLE ERROR | CALCULATORY FEEDING ERROR |
|---|---|---|---|---|---|---|
| 1 | 1440.000 | 15079.64 | 1440.000 | 15079.64 | 0.000 | 0.000 |
| 2 | 1440.000 | 15079.64 | 1440.000 | 15079.64 | 0.000 | 0.000 |
| 3 | 1440.000 | 15079.64 | 1440.000 | 15079.64 | 0.000 | 0.000 |
| · | 1440.000 | 15079.64 | 1440.000 | 15079.64 | 0.000 | 0.000 |
| · | 1440.000 | 15079.64 | 1440.000 | 15079.64 | 0.000 | 0.000 |
| · | 1440.000 | 15079.64 | 1440.000 | 15079.64 | 0.000 | 0.000 |
| · | 1440.000 | 15079.64 | 1440.000 | 15079.64 | 0.000 | 0.000 |
| · | 1440.000 | 15079.64 | 1440.000 | 15079.64 | 0.000 | 0.000 |
| · | 1440.000 | 15079.64 | 1440.000 | 15079.64 | 0.000 | 0.000 |
| 80 | 1440.000 | 15079.64 | 1440.000 | 15079.64 | 0.000 | 0.000 |

FIG.22

| FEED NO. | FEEDING ERROR DUE TO ECCENTRICITY JGMA CLASS 0 | | | | | | |
|---|---|---|---|---|---|---|---|
| | A | B - 1 | B - 2 | C | D | TOTAL | |
| 1 | . | . | . | . | . | . | |
| . | . | . | . | . | . | . | |
| . | . | . | . | . | . | . | |
| . | . | . | . | . | . | . | |
| 80 | . | . | . | . | . | . | |
| | 0.00 | 0.00 | 0.00 | 0.01 | 0.00 | 0.01 | AVERAGE VALUE |
| | 0.00 | - 0.47 | 0.00 | - 1.16 | - 0.56 | - 2.09 | MINIMUM VALUE |
| | 0.00 | 0.47 | 0.00 | 1.16 | 0.56 | 2.13 | MAXIMUM VALUE |
| | 0.00 | 0.47 | 0.00 | 0.84 | 0.40 | 1.02 | STANDARD DEVIATION |

FIG.23

| FEED NO. | FEEDING ERROR DUE TO ECCENTRICITY JGMA CLASS 0 | | | | | | |
|---|---|---|---|---|---|---|---|
| | A | B - 1 | B - 2 | C | D | TOTAL | |
| 1 | 0.00 | - 0.47 | - 2.65 | - 1.05 | - 0.56 | - 4.74 | |
| 2 | 0.00 | 0.47 | 2.66 | - 1.15 | - 0.53 | 1.44 | |
| 3 | 0.00 | - 0.47 | - 2.65 | - 1.10 | - 0.46 | - 4.67 | |
| 4 | 0.00 | 0.47 | 2.66 | - 0.90 | - 0.33 | 1.89 | |
| 5 | 0.00 | - 0.47 | - 2.65 | - 0.57 | - 0.17 | - 3.87 | |
| 6 | 0.00 | 0.47 | 2.66 | - 0.17 | 0.00 | 2.95 | |
| 7 | 0.00 | - 0.47 | - 2.65 | 0.26 | 0.17 | - 2.69 | |
| 8 | 0.00 | 0.47 | 2.66 | 0.65 | 0.33 | 4.11 | |
| 9 | 0.00 | - 0.47 | - 2.65 | 0.95 | 0.46 | - 1.71 | |
| 10 | 0.00 | 0.47 | 2.66 | 1.13 | 0.54 | 4.79 | |
| ⋮ | ⋮ | ⋮ | ⋮ | ⋮ | ⋮ | ⋮ | |
| 80 | 0.00 | 0.47 | 2.66 | 0.94 | - 0.53 | 3.53 | |
| | 0.00 | 0.00 | 0.00 | 0.01 | 0.00 | 0.01 | AVERAGE VALUE |
| | 0.00 | - 0.47 | - 2.65 | - 1.16 | - 0.56 | - 4.74 | MINIMUM VALUE |
| | 0.00 | 0.47 | 2.66 | 1.16 | 0.56 | 4.79 | MAXIMUM VALUE |
| | 0.00 | 0.47 | 2.67 | 0.84 | 0.40 | 3.28 | STANDARD DEVIATION |

FIG.25

| FEED NO. | FEEDING ERROR DUE TO ECCENTRICITY JGMA CLASS 1 | | | | | | |
|---|---|---|---|---|---|---|---|
| | A | B - 1 | B - 2 | C | D | TOTAL | |
| 1 | • | • | • | • | • | • | |
| • | • | • | • | • | • | • | |
| • | • | • | • | • | • | • | |
| • | • | • | • | • | • | • | |
| 80 | • | • | • | • | • | • | |
| | 0.00 | 0.00 | 0.00 | 0.01 | 0.00 | 0.01 | AVERAGE VALUE |
| | 0.00 | - 0.67 | 0.00 | - 1.66 | - 0.82 | - 2.99 | MINIMUM VALUE |
| | 0.00 | 0.67 | 0.00 | 1.65 | 0.82 | 3.06 | MAXIMUM VALUE |
| | 0.00 | 0.67 | 0.00 | 1.20 | 0.58 | 1.46 | STANDARD DEVIATION |

FIG.27

| FEED NO. | FEEDING ERROR DUE TO ECCENTRICITY JGMA CLASS 1 | | | | | | |
|---|---|---|---|---|---|---|---|
| | A | B - 1 | B - 2 | C | D | TOTAL | |
| 1 | • | • | • | • | • | • | |
| • | • | • | • | • | • | • | |
| • | • | • | • | • | • | • | |
| • | • | • | • | • | • | • | |
| 80 | • | • | • | • | • | • | |
| | 0.00 | 0.00 | 0.00 | 0.01 | 0.00 | 0.01 | AVERAGE VALUE |
| | 0.00 | - 0.67 | - 4.55 | - 1.66 | - 0.82 | - 7.54 | MINIMUM VALUE |
| | 0.00 | 0.67 | 4.55 | 1.65 | 0.82 | 7.61 | MAXIMUM VALUE |
| | 0.00 | 0.67 | 4.58 | 1.20 | 0.58 | 5.42 | STANDARD DEVIATION |

FIG.29

SHEET MEMBER FEEDING DEVICE, RECORDING APPARATUS EMPLOYING THE SAME AND IMAGE PICK-UP APPARATUS WITH RECORDING MECHANISM

This application is based on Patent Application No. 2000-277330 filed Sep. 12, 2000 in Japan, the content of which is incorporated hereinto by reference.

BACKGROUND OF THE INVENTION

1. Field of the Invention

The present invention relates to a sheet member feeding device for intermittently feeding a sheet member for a predetermined amount, a recording apparatus employing the same, and an image pick-up apparatus with the recording mechanism employing the same.

2. Description of Prior Art

In a recording apparatus, such as a printer or the like, a feeding device for intermittently feeding a printing medium for a predetermined feeding amount across a recording portion for forming a desired image on the printing medium, is provided in a feeding passage of the printing medium. The feeding device is primarily constructed with a feeding roller unit for feeding the printing medium while pinching the printing medium, a driving motor for supplying a driving force for the feeding roller unit and a speed reduction mechanism portion for transmitting the driving force of the driving motor to the feeding roller unit at a reduced predetermined speed, for example.

The feeding roller unit is arranged at an upstream portion of a recording portion in the feeding path and extends substantially perpendicular to a feeding direction of the printing medium. The feeding roller unit is driven intermittently per a predetermined rotational angle according to the progress of a printing operation. Angular displacement of the feeding roller unit per one time corresponds to a feeding amount of the printing medium per one time and is set depending upon the mode or speed of the recording operation of the recording portion. At this time, relatively high precision of the feeding amount of the printing medium per one time is required. In particular, in order to increase the resolution of the image to be formed on the printing medium so as to achieve relatively high resolution and increase feeding amount of the printing medium at one time, image degradation including white lines and dark lines due to error of feeding amount can be formed on the basis of error in the feeding amount. Thus, relatively high precision of feeding amount is required for avoiding degradation of printed image quality. For this reason, it is required to make an error in angular displacement of the feeding roller unit at one time relative to a predetermined reference angle relatively small.

As the driving motor is a stepping motor or a DC motor, for example, the number of output revolutions thereof is relatively high, and the output torque is relatively small. Therefore, a driving force of the driving motor is supplied to the feeding roller unit with a reduction of rotation speed and an increase in torque by the speed reduction mechanism portion, as discussed above.

The speed reduction mechanism portion is constructed with a gear train having a predetermined gear ratio, for example.

When a driving force from the driving motor is intermittently transmitted to the feeding roller unit via the speed reduction mechanism, error in the feeding amount of the printing medium by the feeding roller unit is cumulative of machining precision of respective gears in a power transmission path including the driving motor, the speed reduction mechanism portion and the feeding roller unit, such as tolerance in precision of tooth space run-out of respective gears, for example.

However, in order to further enhance precision in the feeding amount, since there is a limitation in improving precision of tooth space run-out of the gear, error in the rotation angle of the feeding roller unit relative to the predetermined reference angle due to accumulated tolerance in machining respective gears, namely error in the feeding amount of the printing medium by the feeding roller unit, is still caused. Also, when machining precision of respective gears is the same class of accuracy of machining each other, the smaller the modules of the gear that make up the speed reduction mechanism portion due to demand for downsizing of the recording apparatus becomes, the greater the tooth space run-out in the smaller diameter gear tends to become. Therefore, error in the feeding amount of the recording medium in the feeding roller unit becomes large.

SUMMARY OF THE INVENTION

The present invention has been worked out in view of the drawbacks in the prior art. The present invention relates to a sheet member feeding device for intermittently feeding a sheet member for a predetermined amount, a recording apparatus employing the same, and an image pick-up apparatus with the recording mechanism employing the same. It is an object of the present invention to provide a sheet feeding device which can reduce variations of error in feeding amount of a sheet member to be fed due to tooth space run-out of a gear irrespective of the maximum and the minimum of the module of the gear, a recording apparatus employing the same, and an image pick-up apparatus with a recording mechanism including the recording apparatus.

In a first aspect of the present invention, there is provided a sheet member feeding device comprising:

- a first gear transmitting a driving force to a feeding roller for intermittently feeding a sheet member per a predetermined feeding amount;
- a second gear having a first mark and a second mark representative of a maximum eccentric position and a minimum eccentric position along a radial direction relative to a predetermined concentric circle in tooth space, in opposition to each other, and directly or indirectly transmitting a driving force to the first gear;
- a third gear directly or indirectly transmitting driving force from driving means to the second gear;
- detecting means for detecting the first mark and the second mark in the second gear and transmitting a detection output; and
- a control portion operating the driving means so as to rotate the second gear through 180° between the first mark and the second mark with respect to feeding for a feeding amount of the sheet member for one time, on the basis of the detection output from the detecting means.

In a second aspect of the present invention, there is provided a printing apparatus comprising:

- a sheet member feeding device;
- a printing portion performing a printing operation on a surface of a sheet member intermittently fed by the sheet member feeding device; and
- a control portion performing operation control of the printing portion.

In a third aspect of the present invention, there is provided an image pick-up apparatus with a printing mechanism comprising a printing apparatus and an image pick-up mechanism.

As will be clear from the discussion hereabove, the sheet member feeding device, the printing apparatus employing the same and the image pick-up device having a printing mechanism according to the present invention, are provided with a first gear transmitting a driving force to a feeding roller for intermittently feeding a sheet member per a predetermined feeding amount, a second gear having a first mark and a second mark representative of a maximum eccentric position and a minimum eccentric position along a radial direction relative to a predetermined concentric circle in tooth space, in opposition to each other, and directly or indirectly transmitting a driving force to the first gear, a third gear directly or indirectly transmitting driving force from driving means to the second gear, and detecting means for detecting the first mark and the second mark in the second gear and transmitting a detection output. The control portion operates the driving means so as to rotate the second gear over 180° between the first mark and the second mark with respect to feeding for a feeding amount of the sheet member for one time, on the basis of the detection output from the detecting means for reducing variations of error of feeding amount of the sheet due to tooth space run-out of the gear without depending upon large and small of the module of the gear.

The above and other objects, effects, features and advantages of the present invention will become more apparent from the following description of embodiments thereof taken in conjunction with the accompanying drawings.

BRIEF DESCRIPTION OF THE DRAWINGS

FIG. 20 is a table showing each data of the gear train that makes up the speed reduction mechanism portion in the embodiment shown in FIG. 16;

FIG. 22 is a table for explaining a "conversion feeding error" in the embodiment shown in FIG. 20;

FIG. 23 is a table for explaining a "conversion feeding error" of each gear in the embodiment shown in FIG. 20;

FIG. 25 is a table for explaining a "conversion feeding error" of each gear in a comparative example 1;

FIG. 27 is a table for explaining the "conversion feeding error" of each gear in another embodiment of the gear train forming the speed reduction mechanism portion in the embodiment shown in FIG. 15;

FIG. 29 is a table for explaining a conversion error of each gear in the comparative example 2.

DETAILED DESCRIPTION OF THE PREFERRED EMBODIMENTS

Embodiments of the present invention will be described below by referring to the accompanying drawings.

In the present specification, "printing" (also referred to as "recording" in some cases) means not only a condition of forming significant information such as characters and drawings, but also a condition of forming images, designs, patterns and the like on printing medium generally, or a condition of processing such a printing medium, regardless of significance or of being actualized in a manner receivable by human visual perception.

Also, a "printer" and a "recording apparatus" mean not only one complete apparatus for carrying out a printing but also an apparatus having a function for printing.

Further, the "printing medium" means not only a paper used in a conventional printing apparatus but anything capable of accepting inks, such as fabrics, plastic films, metal plates, glass, ceramics, wood and leathers, and in the following, will be also represented by a "sheet" or simply by a "paper".

Further, in the present specification, a "camera" indicates an apparatus or device that optically photographs an image and converts the photographed image into electrical signals, and in the following explanation, is also referred to as a "photographing section".

Still further, an "ink" (also referred to as "liquid" in some cases) should be interpreted in a broad sense as well as a definition of the above "printing" and thus the ink, by being applied on the printing mediums, shall mean a liquid to be used for forming images, designs, patterns and the like, processing the printing medium or processing inks (for example, coagulation or encapsulation of coloring materials in the inks to be applied to the printing mediums).

One embodiment of a head to which the present invention is advantageously employed is the embodiment in which thermal energy generated by an electrothermal converter is utilized to cause film boiling in a liquid resulting in a formation of bubbles.

[Basic Structure]

Firstly, a basic structure of a device according to the present invention will be explained in view of FIGS. 1 to 14. The device explained in the present embodiments is constituted as an information processing equipment comprising a photographing section for optically photographing an image and then converting the photographed image into electric signals (hereinafter, also referred to as "camera section") and an image recording section for recording an image on the basis of thus obtained electric signals (hereinafter, also referred to as "printer section"). Hereinafter, the information processing equipment in the present embodiments is explained in the name of a "printer-built-in camera".

Figure 5:
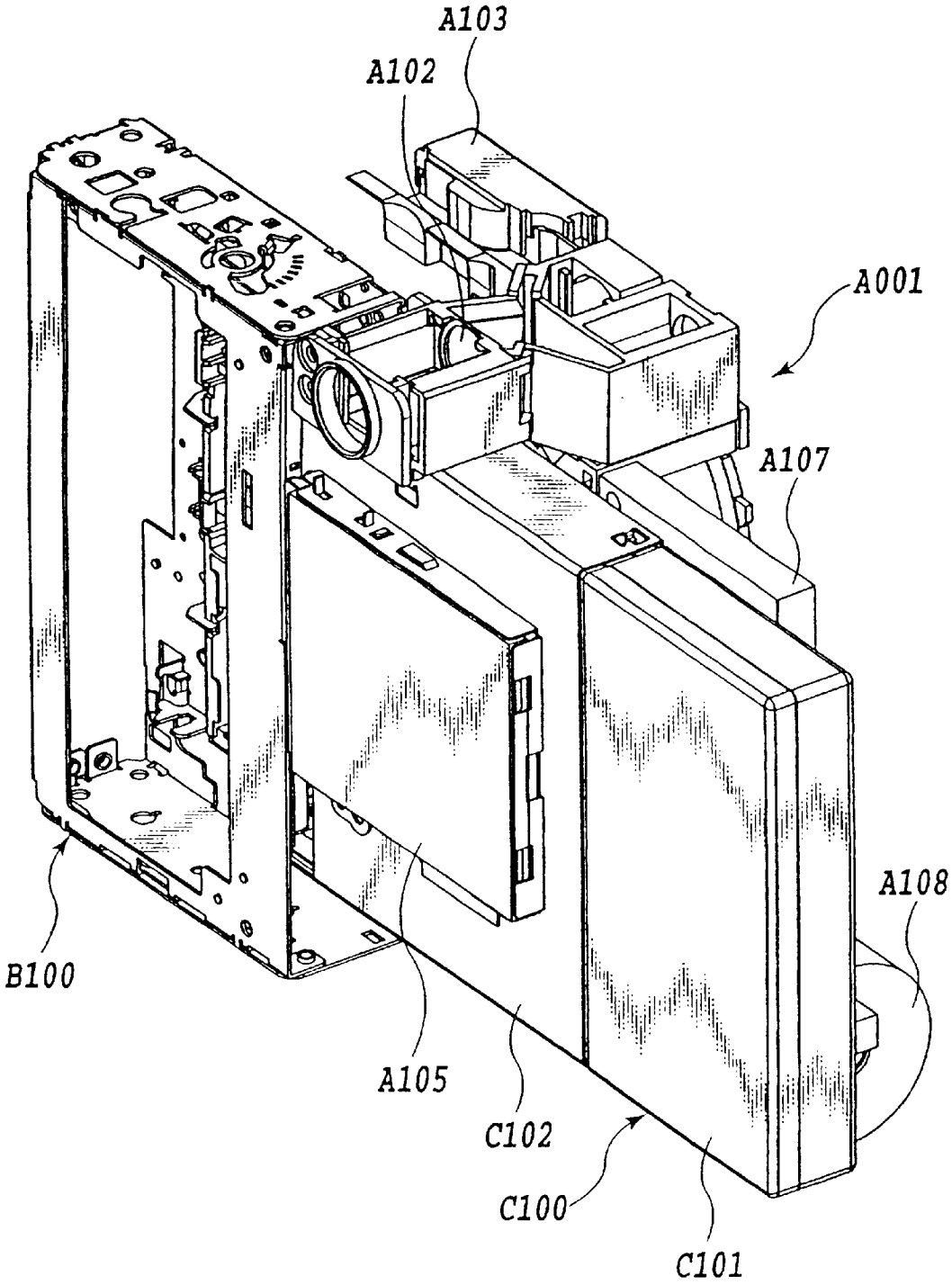
FIG. 5 is a perspective view showing an arrangement of the main components within the camera in FIG. 1.

In a main body A001, there is incorporated a printer section (recording apparatus section) B100 at the backside of a camera section A100 in an integral manner. The printer section B100 records an image by using inks and printing mediums which are supplied from a medium pack C100. In the present structure, as apparent from FIG. 5 illustrating the main body A001 when viewed from the backside with an outer package removed, the medium pack C100 is inserted at the right hand side of the main body A001 in FIG. 5 and the printer section B100 is arranged at the left hand side of the main body A001 in FIG. 5. In the case of performing a recording by the printer section B100, the main body A001 can be placed facing a liquid crystal display section A105 and a lens A101. In this recording position, a recording head B120 of the printer section B100, which will be described below, is made to be positioned to eject inks in the downward direction. The recording position can be made to be the same position as that of photographing condition by the camera section A100 and thus is not limited to the recording position as mentioned above. However, in view of a stability of a recording operation, the recording position capable of ejecting the inks in the downward direction is preferred.

There follows the explanations of the basic mechanical structure according to the present embodiment under the headings of 1 as "Camera Section", 2 as "Medium Pack" and 3 as "Printer Section", and of the basic structure of the signal processing under the heading of 4 as "Signal Processing".

1: Camera Section

Figure 1:
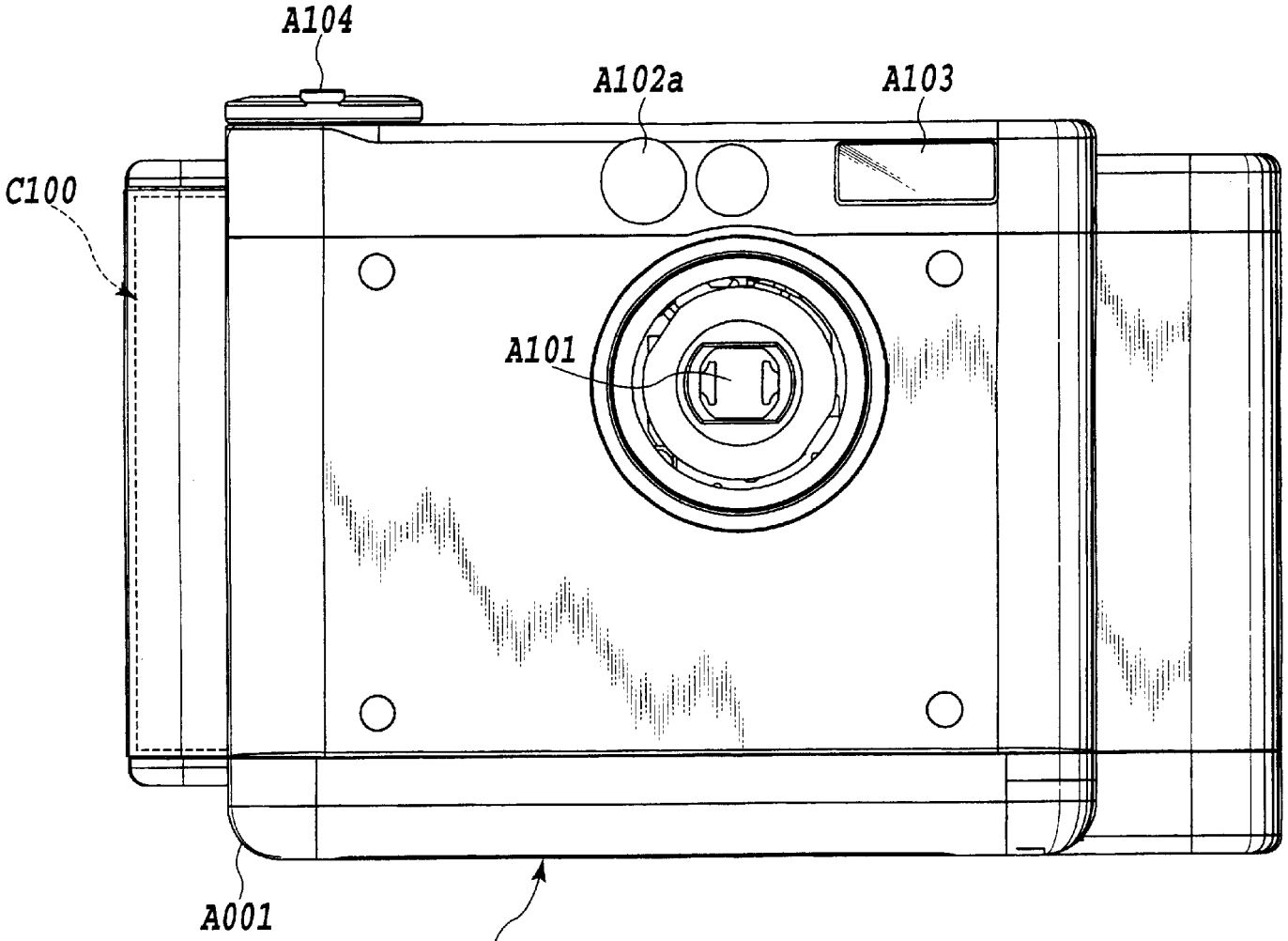
FIG. 1 is a front elevation view of a printer-built-in camera to which the present invention is applicable.
Figure 2:
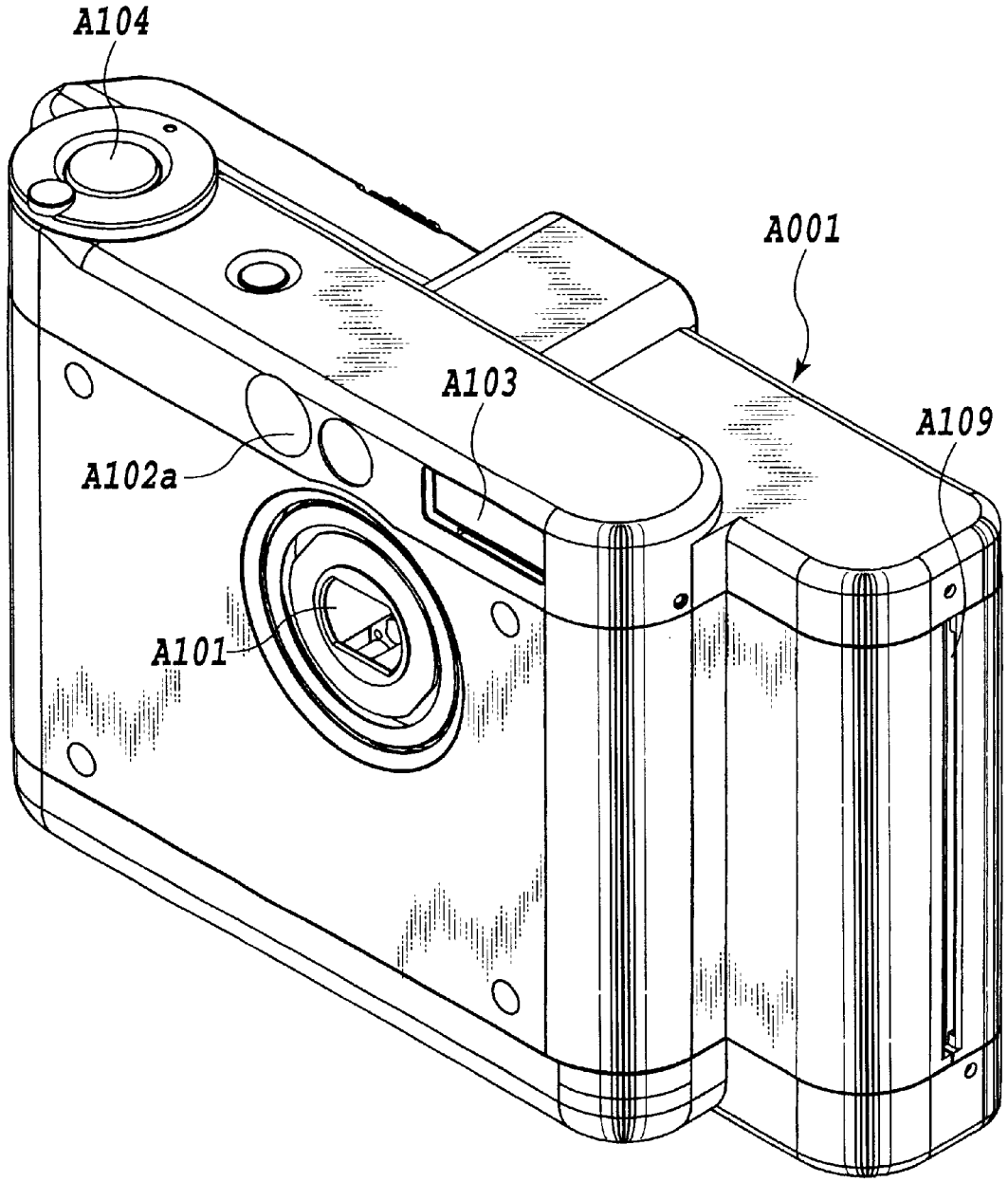
FIG. 2 is a perspective view of the camera in FIG. 1 when viewed diagonally from the front thereof.
Figure 3:
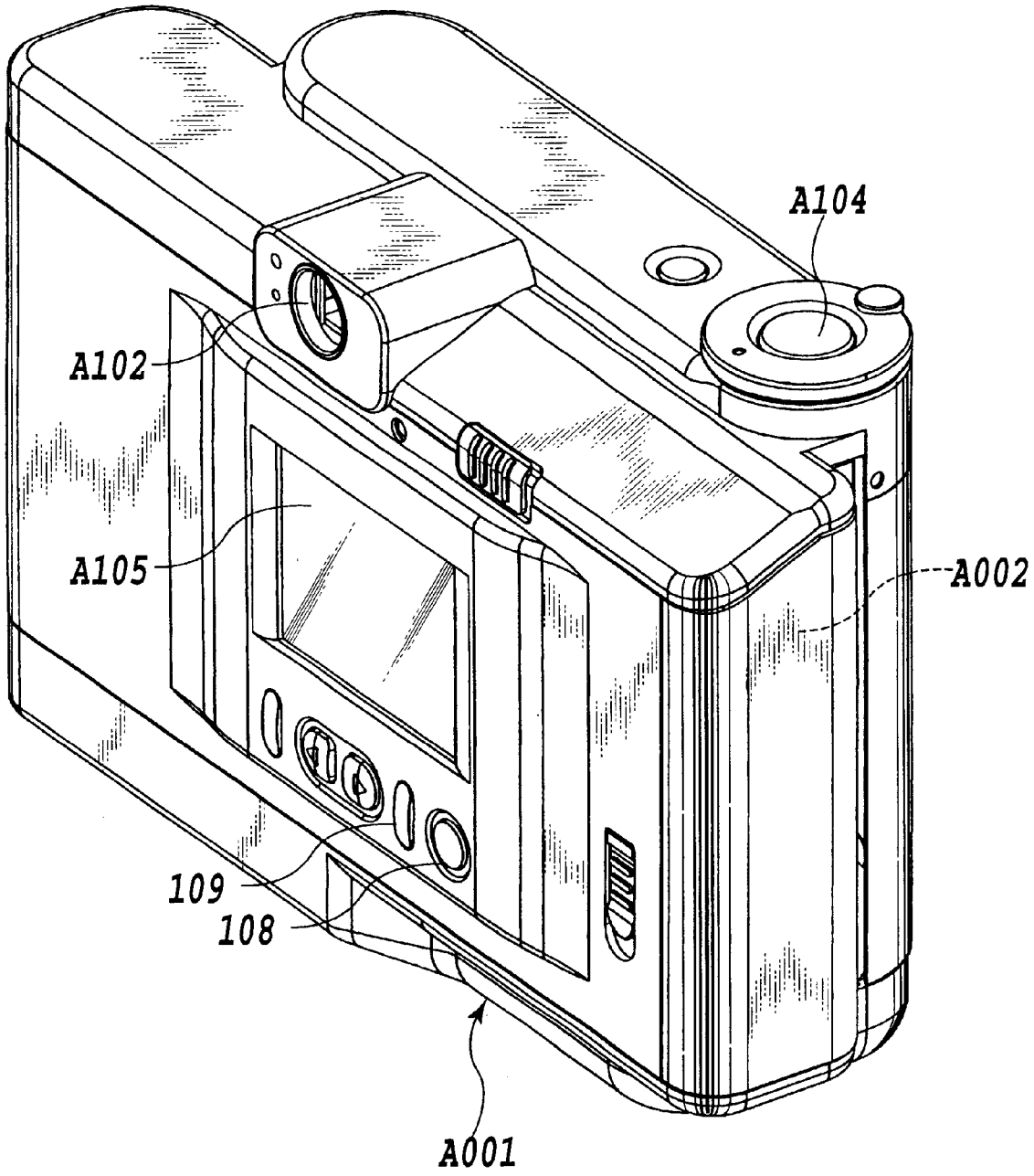
FIG. 3 is a perspective view of the camera in FIG. 1 when viewed diagonally from the back thereof.

The camera section A100, which basically constitutes a conventional digital camera, constitutes the printer-built-in digital camera having an appearance in FIGS. 1 to 3 by being integrally incorporated into the main body A001 together with a printer section B100 described below. In FIGS. 1 to 3, A101 denotes a lens; A102 denotes a viewfinder; A102*a* denotes a window of the viewfinder; A103 denotes a flash; A104 denotes a shutter release button; and A105 denotes a liquid crystal display section (outer display section). The camera section A100, as described below, performs a processing of data photographed by CCD, a recording of the images to a compact flash memory card (CF card) A107, a display of the images and a transmission of various kinds of data with the printer section B100. A109 denotes a discharge part for discharging a printing medium C104 on which the photographed image is recorded. A108, as shown in FIG. 5, is a battery as a power source for the camera section A100 and the printer section B100.

2: Medium Pack

Figure 4:
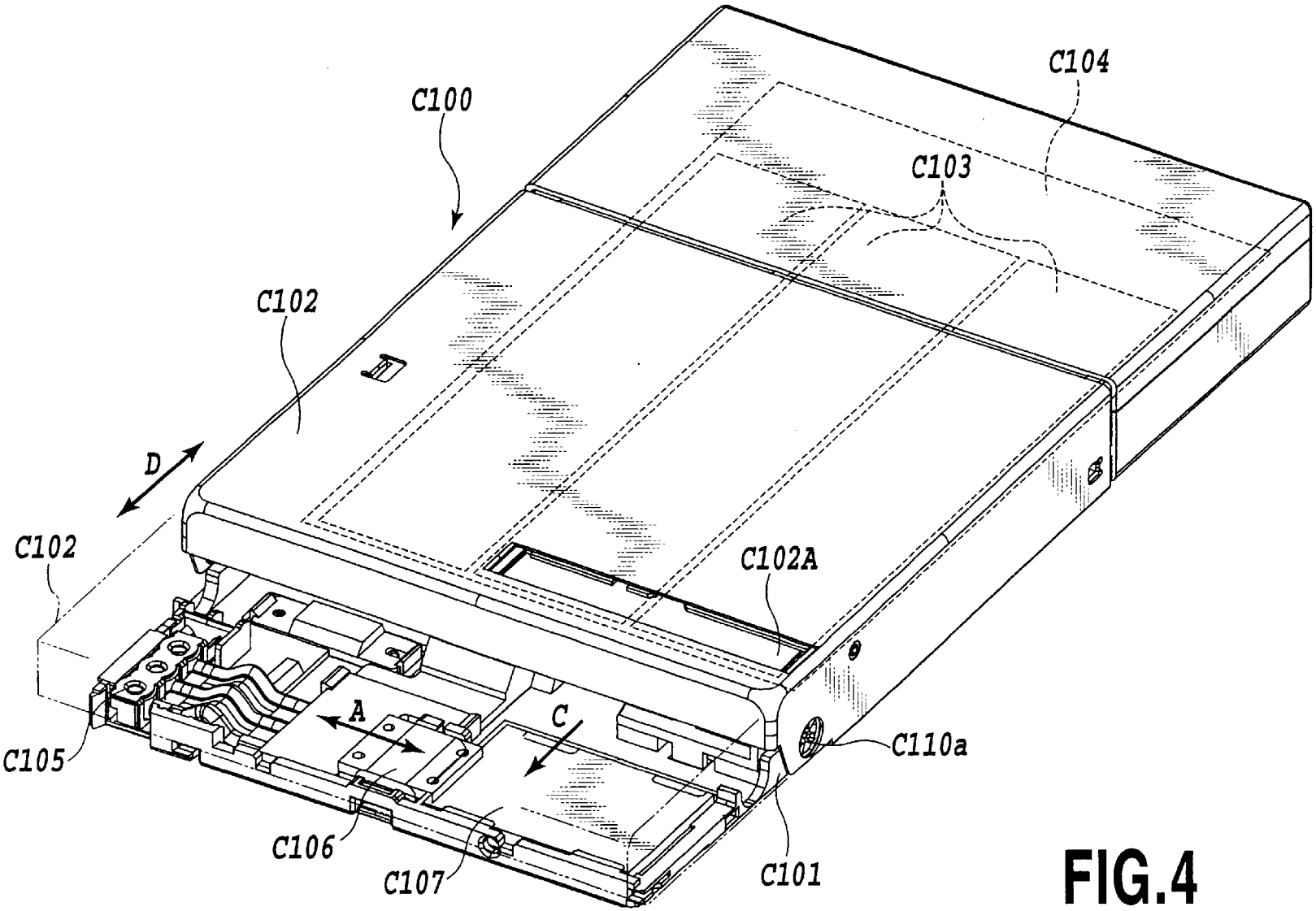
FIG. 4 is a perspective view of a medium pack insertable to the camera in FIG. 1.

A medium pack C100 is detachably mountable to a main body A001 and, in the present embodiment, is inserted through an inserting section A002 of the main body A001 (see FIG. 3), thereby being placed in the main body A001, as shown in FIG. 1. The inserting section A002 is closed as shown in FIG. 3 when the medium pack C100 is not inserted therein, and is opened when the medium pack is inserted therein. FIG. 5 illustrates a status wherein a cover is removed from the main body A001 to which the medium pack C100 is inserted. As shown in FIG. 4, a shutter C102 is provided with a pack body C101 of the medium pack C100 in a manner so as to be slidable in an arrow D direction. The shutter C102, which slides to stay at a position indicated by the two-dots-and-dashed lines in FIG. 4 when the medium pack C100 is not inserted in the main body A001, also slides to a position indicated by the solid lines in FIG. 4 when the medium pack C100 is placed in the main body A001.

The pack body C101 contains ink packs C103 and printing mediums C104. In FIG. 4, the ink packs C103 are held under the printing mediums C104. In the case of the present embodiment, three ink packs C103 are provided so as to separately hold the inks of Y (yellow), M (magenta) and C (cyan), and about twenty sheets of the printing mediums C104 are stored in a stack. A suitable combination of those inks and the printing mediums C104 for recording an image is selected to be stored within the medium pack C100. Accordingly, the various medium packs C100 each having a different combination of the inks and the printing mediums (for example, medium packs for super high-quality image; for normal image; and for sealing (seal partitioning)) are prepared and, according to a kind of images to be recorded and a use of the printing medium on which an image is formed, those medium packs C100 are selectively inserted in the main body A001, thereby being able to perform an ensured recording of the images in compliance with the purpose by employing the most suitable combination of the ink and the printing medium. Further, the medium pack C100 is equipped with the below-mentioned EEPROM to which is recorded the identification data such as kinds or remaining amounts of the inks and the printing mediums contained in the medium pack.

The ink pack C103, upon the medium pack C100 is inserted in the main body A001, is connected to an ink supply system in the main body A001, through three joints C105 each corresponding to the respective inks of Y, M and C. On the other hand, the printing mediums C104 are separated one by one using a separating mechanism which is not shown in the figures and then sent in a direction of an arrow C by a paper feeding roller C110 (see FIG. 9). A driving force of the paper feeding roller C110 is supplied from an after-mentioned conveying motor M002 (see FIG. 9) provided on the main body A001 through a connecting portion C110*a*.

Further, the pack body C101 comprises a wiper C106 for wiping a recording head of the after-mentioned printer section, and an ink absorption body C107 for absorbing the abolished inks discharged from the printer section. The recording head in the printer section reciprocates in a direction of the main scanning direction as indicated by an arrow A in a manner described below. When the medium pack C100 is in the status of being removed from the main body A001, the shutter C102 slides to a position indicated by the two-dots-and-dashed lines in FIG. 4 to protect the joints C105, the wiper C106, the ink absorbing body C107 and so on.

3: Printer Section

The printer section B100 according to the present embodiment is a serial type employing an ink jet recording head. This printer section B100 is explained under the headings of 3-1 "Printing Operating Section"; 3-2 "Printing Medium Carrying"; and 3-3 "Ink Supplying System", respectively.

3-1: Printing Operating Section

Figure 6:
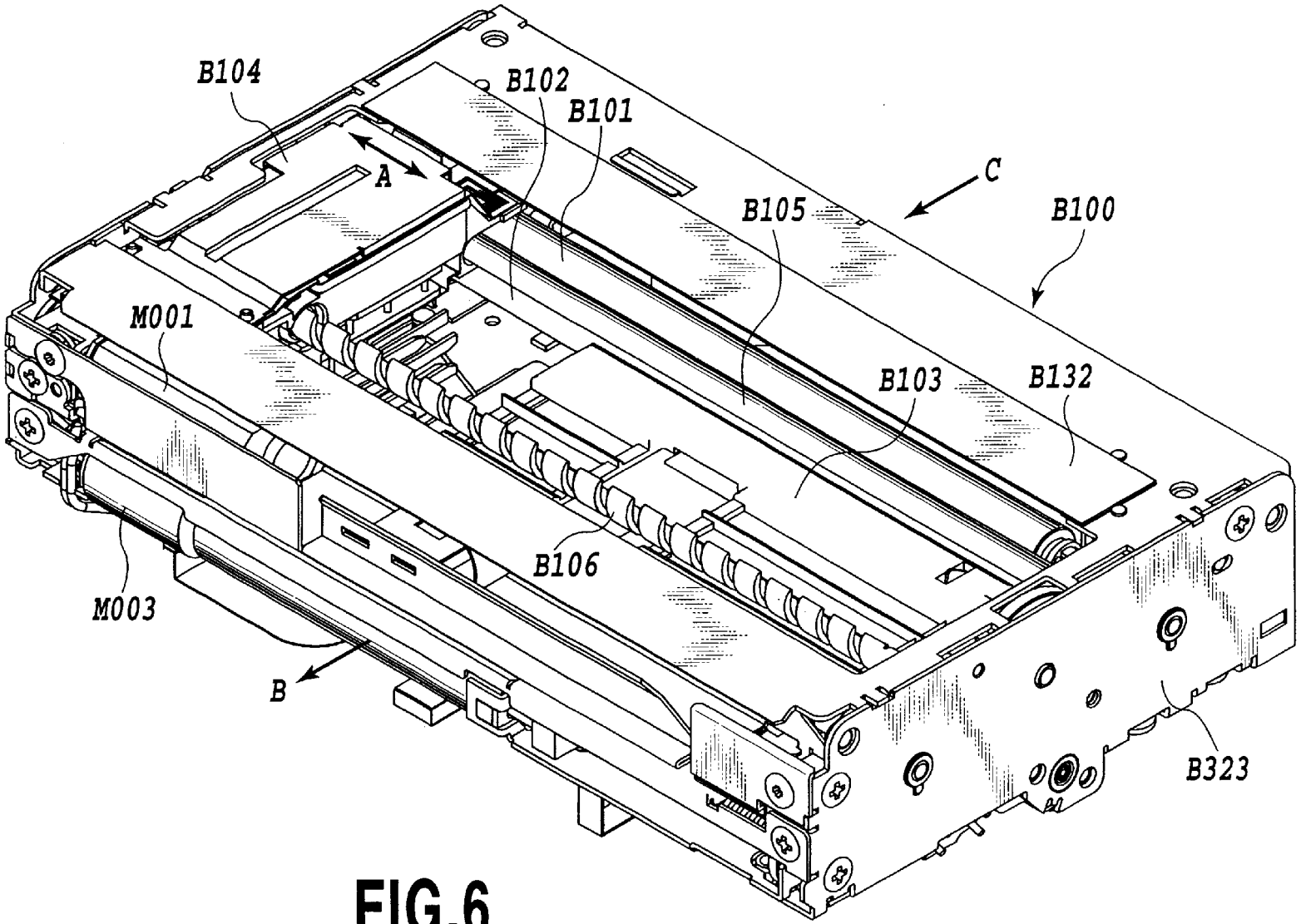
FIG. 6 is a perspective view of a printer section in FIG. 5.
Figure 7:
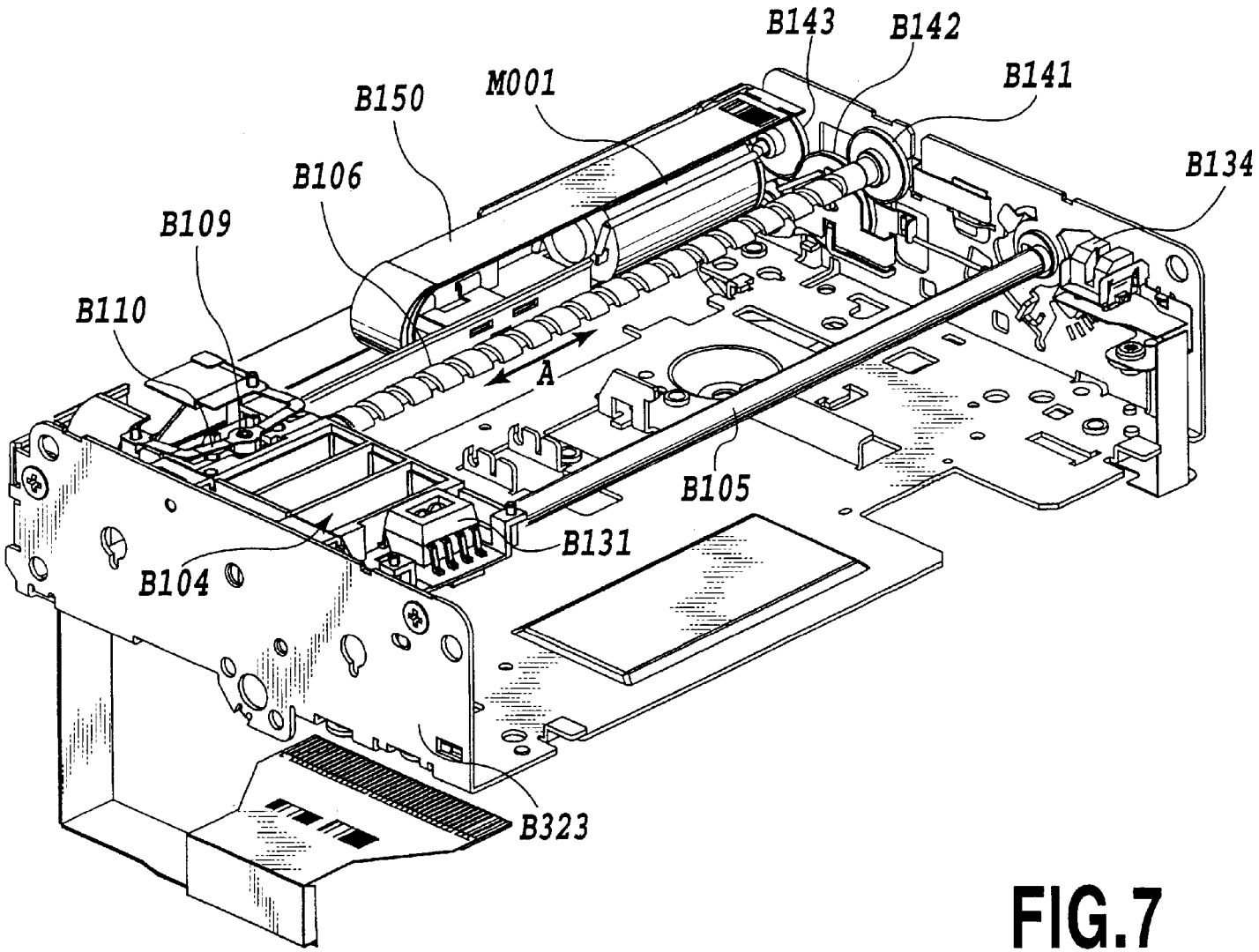
FIG. 7 is a perspective view in which a portion of the printer section in FIG. 6 is dislodged.

FIG. 6 is a perspective view illustrating the overall printer section B100, and FIG. 7 is a perspective view illustrating the printer section B100 with a part partially taken out.

At a predetermined position in the main body of the printer section B100, a tip portion of the medium pack C100 is positioned when the medium pack C100 is placed in the main body A001 as shown in FIG. 5. The printing medium C104 is delivered in the direction of an arrow C from the medium pack C100, while being sandwiched between a LF roller B101 and a LF pinch roller B102 of the below-mentioned printing medium carrying system, is carried to the sub-scanning direction indicated by an arrow B on a pressure plate B103. B104 denotes a carriage which reciprocates toward a main scanning direction indicated by an arrow A along a guiding shaft B105 and a leading screw B106.

Figure 8:
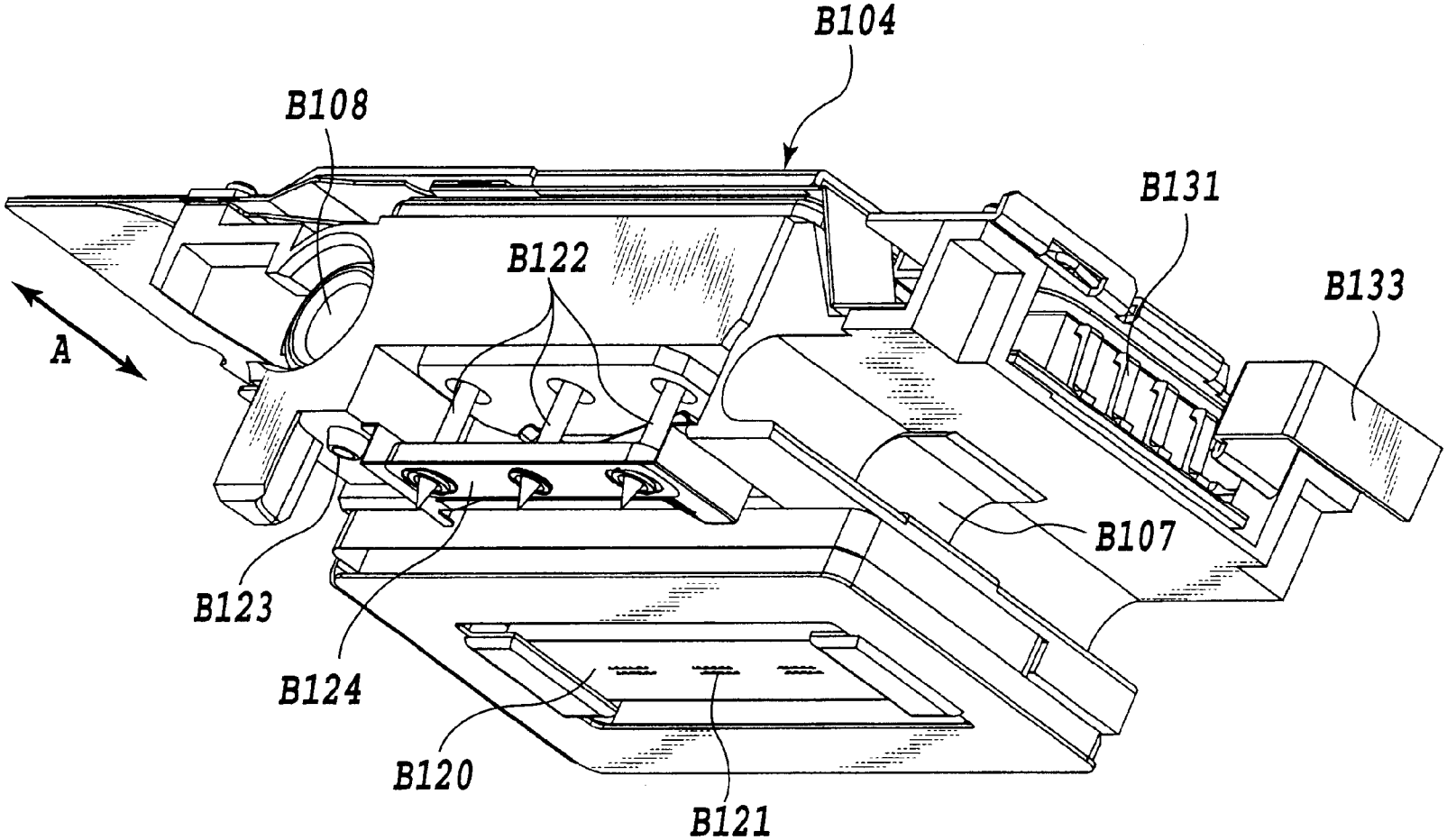
FIG. 8 is a perspective view of a carriage of the printer in FIG. 6.

As shown in FIG. 8, the carriage B104 is provided with a bearing B107 for a guiding shaft B105 and a bearing B108 for a leading screw B106. At a fixed position of the carriage B104, as shown in FIG. 7, a screw pin B109 projecting toward an interior of the bearing B108 is installed by a spring B110. A fit of a tip of the screw pin B109 to a helical thread formed on the outer circumference of the leading screw B106 converts a rotation of the leading screw B106 to a reciprocating movement of the carriage B104.

The carriage B104 is equipped with an ink jet recording head B120 capable of ejecting the inks of Y, M and C, and a sub-tank/reservoir (not shown) for storing inks to be supplied to the recording head B120. On the recording head B120, a plurality of ink ejection openings B121 (see FIG. 8), which are aligned with the direction crossing the main scanning direction indicated by the arrow A (in the present embodiment, an orthogonal direction), are formed. The ink ejection openings B121 form nozzles capable of ejecting inks supplied from the sub-tank. As a generating means of energy for discharging the inks, an electro-thermal converting element equipped with each of the nozzles may be used. The electro-thermal converting element generate's bubble(s) in the ink(s) within the nozzle by generating heat and the thus generated foaming energy causes ejection of an ink droplet from the ink ejection opening B121.

The sub-tank has a capacity smaller than the ink packs C103 contained in the media pack C100 and made to be a sufficient size for storing a required amount of ink for recording an image corresponding to at least one sheet of printing medium C104. In the sub-tank, there are ink reserve sections for each of the inks of Y, M and C, on each of which is formed the ink supplying section and the negative pressure introducing sections, wherein those ink supplying sections are individually connected to the corresponding three hollow needles B122 and those negative pressure introducing sections are also connected to a common air suction opening B123. Such ink supplying sections, as will be mentioned below, are supplied with inks from the ink packs C103 in the medium pack C100 when the carriage B104 moves to a home position as illustrated in FIG. 6.

Figure 11:
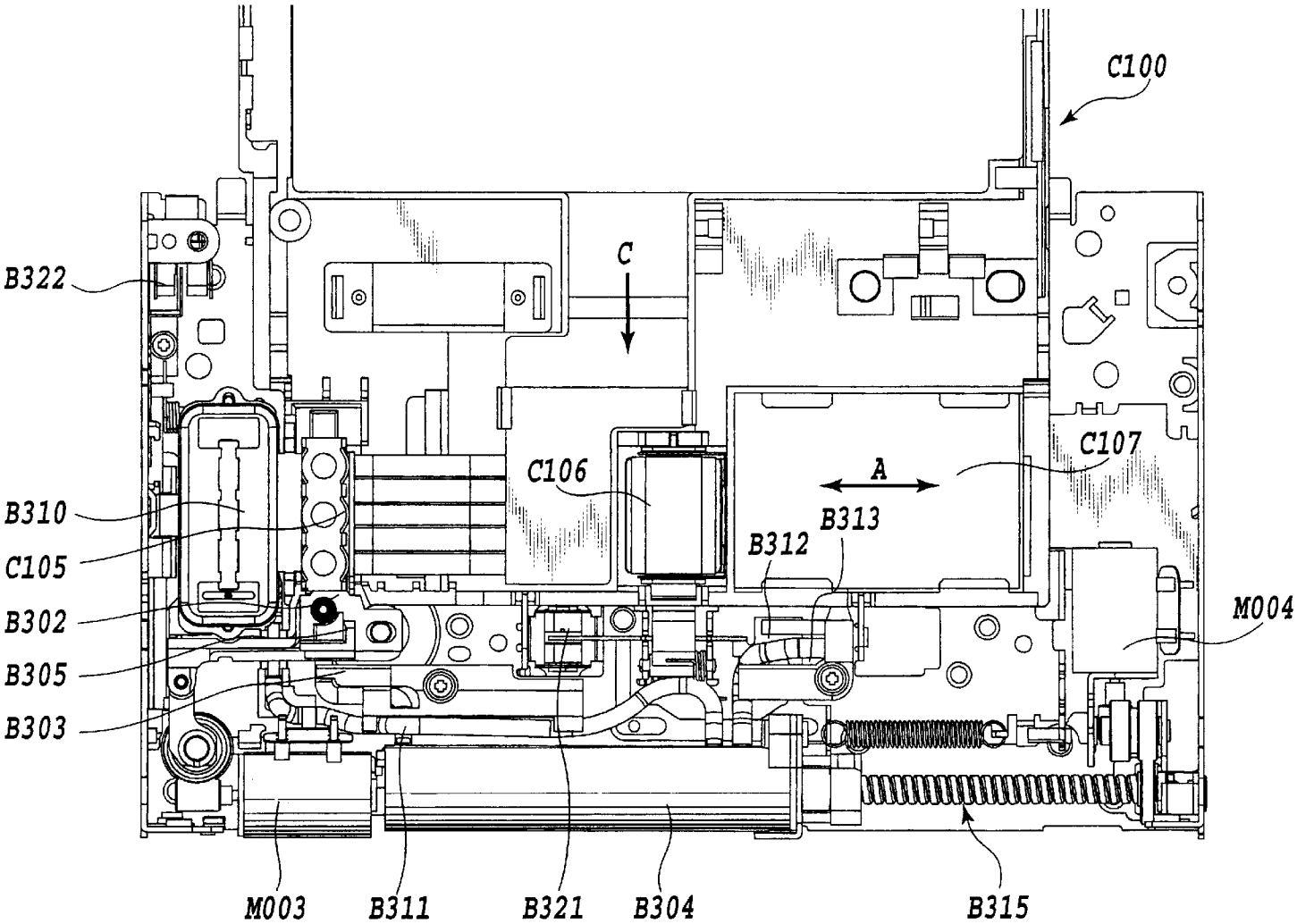
FIG. 11 is a plan view illustrating the medium pack inserted into a component part of the ink supply in FIG. 10.

In the carriage B104 in FIG. 8, B124 denotes a needle cover which is moved to a position for protecting the needles B122 by the force of the springs as illustrated in FIG. 8 when the needles B122 and the joints C105 are not mated to each other, and which releases a protection of the needles B122 by being pushed upwardly against the force of the springs in FIG. 8 when the needles B122 and the joints C105 are mated with each other (see FIG. 11). A movement position of the carriage B104 is detected by an encoder sensor B131 on the carriage B104 and a linear scale B132 (see FIG. 6) on the main body of the printer section B100. Also, a fact that the carriage B104 moves to the home position is detected by a HP (home position) flag B133 on the carriage B104 and a HP sensor B134 (see FIG. 7) on the main body of the printer section B100.

In FIG. 7, at both ends of the guiding shaft B105, supporting shafts (not shown) are provided at a position eccentric to the center axis of the guiding shaft. The guiding shaft B105 is turned and adjusted upon the supporting shaft, thereby controlling a height of the carriage 104, providing adjustment of a distance between the recording head B120 and the printing medium C104 on the pressure plate B103. The leading screw B106 is rotatably driven by a carriage motor M001 through a screw gear B141, an idler gear B142 and a motor gear B143. B150 denotes a flexible cable for electrically connecting the after-mentioned controlling with the recording head B120.

The recording head B120 moves together with the carriage B104 toward the main scanning direction indicated by the arrow A and concurrently ejects droplets of the inks from the ink ejection openings B121 in accordance with image signals, thereby recording an image corresponding to one band on the printing medium on the pressure plate B103. By alternately repeating a recording operation of an image corresponding to one band by such recording head B120 and a conveying operation of the predetermined amount of the printing medium toward the sub-scanning direction indicated by the arrow B by means of the below-mentioned printing medium conveying system, sequential recording of the images on the printing medium is enabled.

3-2: Printing Medium Carrying

Figure 9:
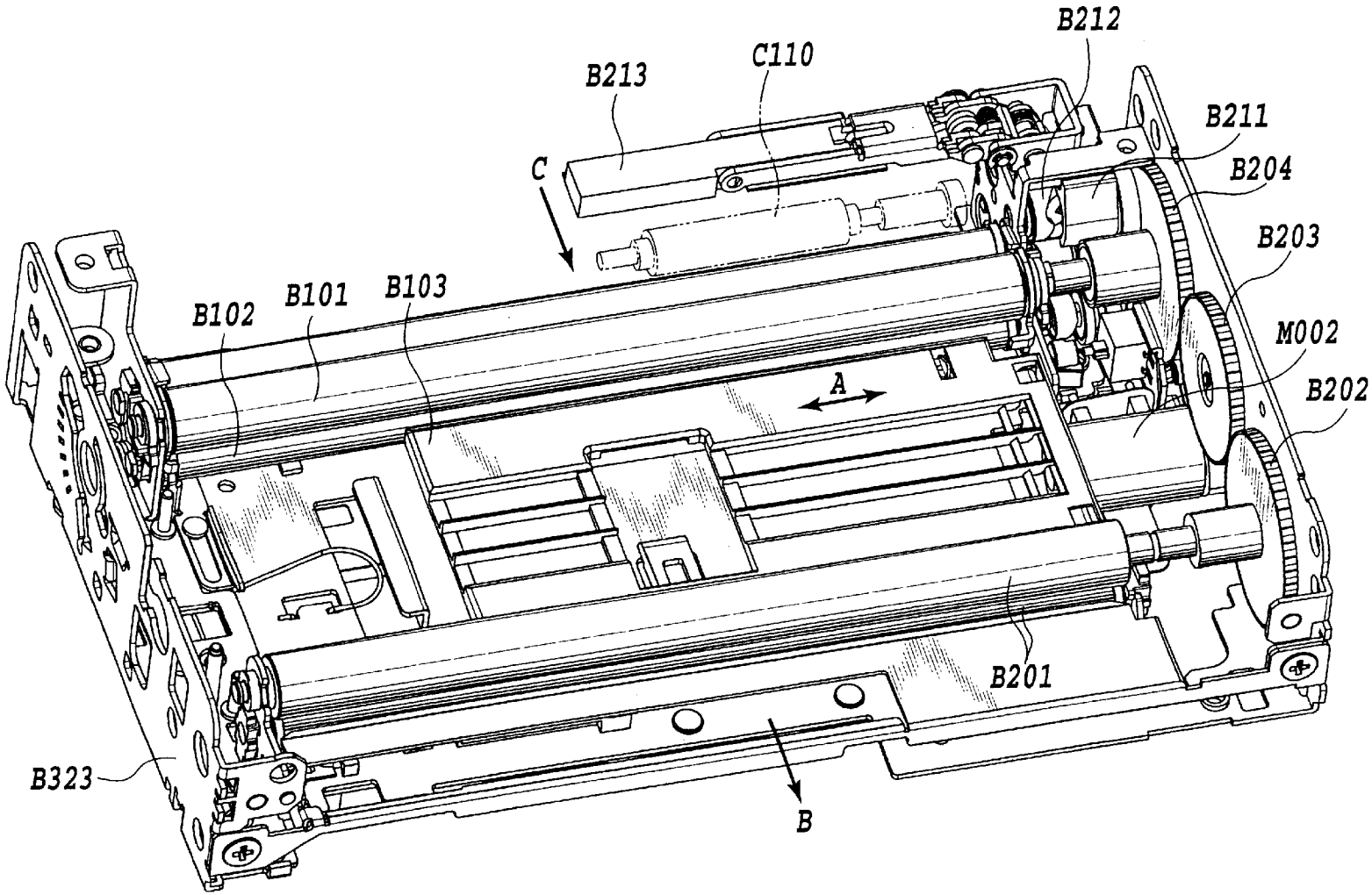
FIG. 9 is a perspective view of a component part of a printing medium carriage of the printer section in FIG. 6.

FIG. 9 is a perspective view showing a component of the printing medium conveying system of the printer section B100. In FIG. 9, B201 denotes a pair of paper delivering rollers, and the upper one of the paper delivering rollers B201 in FIG. 9 is driven by a conveying motor M002 through the paper delivering roller gear B202 and a junction gear B203. Likewise, the aforementioned LF roller B101 is driven by the conveying motor M002 through a LF roller gear B204 and the junction gear B203. The paper delivering roller B201 and the LF roller B101 convey the printing medium C104 toward the sub-scanning direction indicated by the arrow B by a driving force of the conveying motor M002 rotating in the forward direction.

On the other hand, when the conveying motor M002 counter-rotates, a pressure plate head B213 and a locking mechanism which is not shown are driven through a switching slider B211 and a switching cam B212, while a driven force is transmitted to the paper feeding roller C110 on the medium pack C100. That is, the pressure plate head B213 pressurizes the printing mediums C104, which are piled up within the medium pack C100, in a downward direction in FIG. 4 by a driven force caused by a reverse rotation of the carrying motor M002, through a window portion C102A (see FIG. 4) of a shutter C102 of the medium pack C100. As a result thereof, the printing medium C104 positioned at the lowest position in FIG. 4 is pressed against the feeding roller C110 in the medium pack C100. Also, the locking mechanism which is not shown locks the medium pack C100 to the main body A001 to inhibit a removal of the medium pack C100. The feeding roller C110 of the medium pack C100 feeds one piece of the printing medium C104 at the lowest position in FIG. 4 toward the direction indicated by the arrow C as a result that the driven force caused by the reverse rotation of the conveying motor M002 is transmitted.

As stated above, only one piece of printing medium C104 is taken out from the medium pack C100 toward the direction indicated by the arrow C by the reverse rotation of the conveying motor M002, and then a forward rotation of the conveying motor M002 conveys the printing medium C104 to the direction indicated by the arrow B.

3-3: Ink Supplying System

Figure 10:
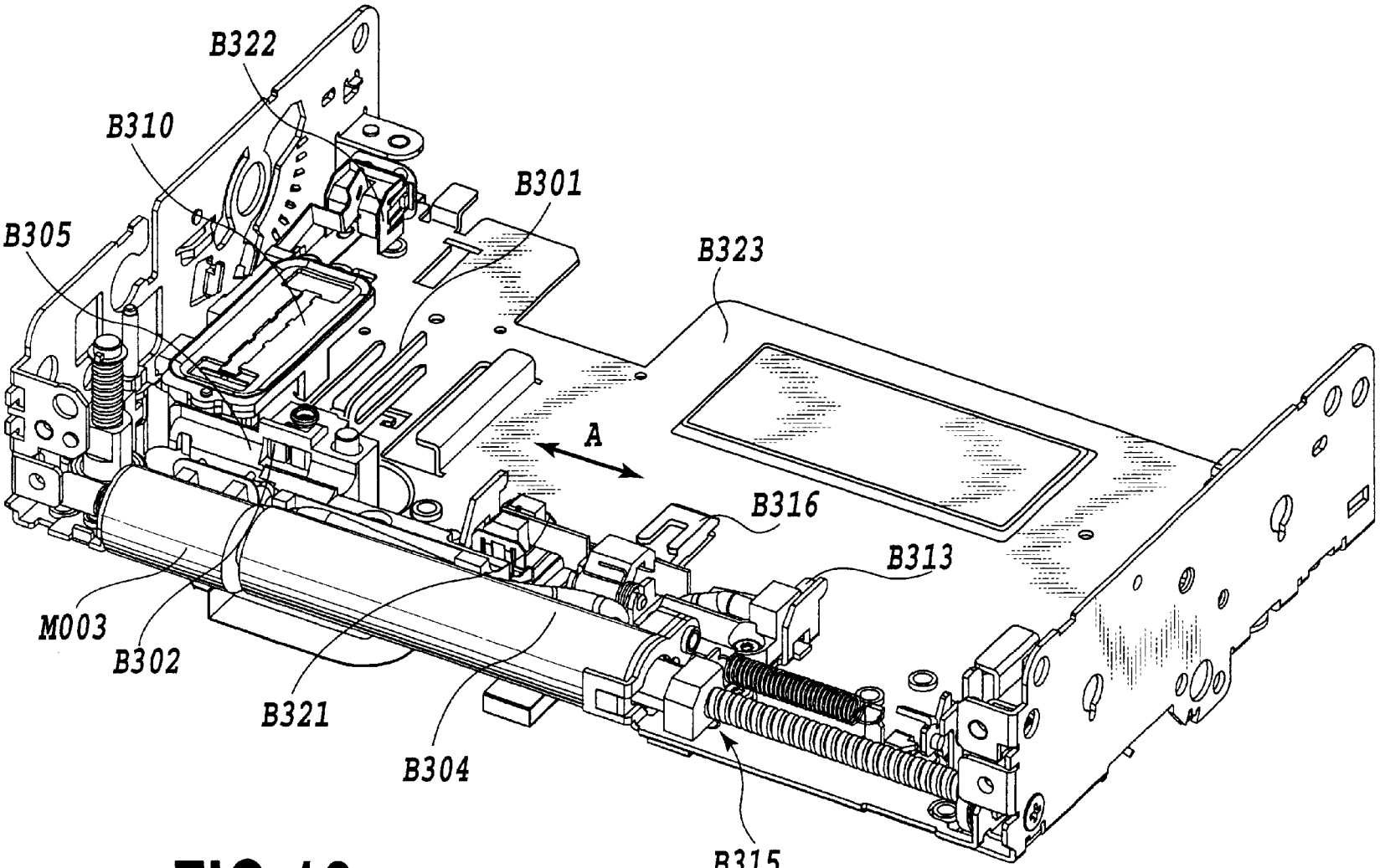
FIG. 10 is a perspective view of a component part of the ink supply of the printer section in FIG. 6.

FIG. 10 is a perspective view showing a component part of an ink supplying system of the printer section B100: FIG. 11 is a plane view showing a status that the medium pack C100 is inserted in the component part of the ink supplying system.

A joint C105 of the medium pack C100 installed to the printer section B100 is positioned below the needles B122 (see FIG. 8) on the carriage B104 moved to a home position. The main body of the printer section B100 is equipped with a joint fork B301 (see FIG. 10) positioned below a joint C105, and an upward movement of the joint C105 caused by the joint fork B301 establishes a connection of the joint C105 to the needles B122. As a result thereof, an ink supplying path is formed between the ink packs C103 in the medium pack C100 and the ink supplying sections on the sub-tank on the carriage B104. Further, the main body of the printer section B100 is equipped with a suction joint B302 positioned below an air suction opening B123 (see FIG. 8) of the carriage B104 moved to the home position. This suction joint B302 is connected to a pump cylinder B304 of a pump serving as a negative pressure generating source, through a suction tube B311. The suction joint B302 is connected to the air suction opening B123 on the carriage B104 according to the upward movement caused by a joint lifter B305. In light of the foregoing, a negative pressure introducing path, between a negative pressure introducing section of the sub-tank on the carriage B104 and the pump cylinder B304, is formed. The joint lifter B305 makes the joint fork B301 move up and down together with the suction joint B302 by a driving power of the joint motor M003.

The negative pressure introducing section of the sub-tank is equipped with a gas-liquid partition member (not shown) which allows a passing through of air but prevents a passing through of the inks. The gas-liquid partition member allows a passing through of the air in the sub-tank to be suctioned through the negative pressure introducing path, and as a result, an ink is supplied to the sub-tank from the medium pack C100. Then, when the ink is sufficiently supplied to the extent that the ink in the sub-tank reaches to the gas-liquid partitioning member, the gas-liquid partitioning member prevents the passing through of the inks, thereby automatically stopping a supply of the inks. The gas-liquid partitioning member is equipped with the ink supplying section in the ink storing sections for the respective inks in the sub-tank, and thus the ink supplying is automatically stopped with respect to each ink storing section.

The main body of the printer section B100 is further equipped with a suction cap B310 capable of capping with respect to the recording head B120 (see FIG. 8) on the carriage B104 which moved to the home position. The suction cap B310 introduces the negative pressure thereinto from the pump cylinder B304 through suction tube B311, so that the inks can be suctioned and emitted (suction recovery processing) from the ink ejection openings B121 of the recording head B120. Further, the recording head B120, as required, makes the ink, which does not contribute to a recording of an image, ejection into the suction cap B310 (preliminary ejection processing). The ink with in the suction cap B310 is discharged into the ink absorption body C107 in the medium pack C110 from the pump cylinder B304 through a waste water liquid tube B312 and a waste liquid joint B313.

The pump cylinder B304 constitutes a pump unit B315 together with a pump motor M004 for enabling reciprocating drive of the pump cylinder. The pump motor M004 also functions as a driving source by which a wiper lifter B316 (see FIG. 10) is moved up and down. The wiper lifter B316 makes the wiper C106 of the medium pack C100 placed in the printer section B100 move upwardly, thereby displacing the wiper C106 to a position capable of a wiping off the recording head B120.

In FIGS. 10 and 11, B321 denotes a pump HP sensor for detecting if an operating position of the pump, which is constituted by the pump cylinder B304, lies at the home position. Further, B322 denotes a joint HP sensor for detecting if the aforementioned ink supplying path and the negative pressure introducing path were formed. Still further, B323 denotes a chassis for constituting a main body of the printer section B100.

4: Signal Processing

Figure 12:
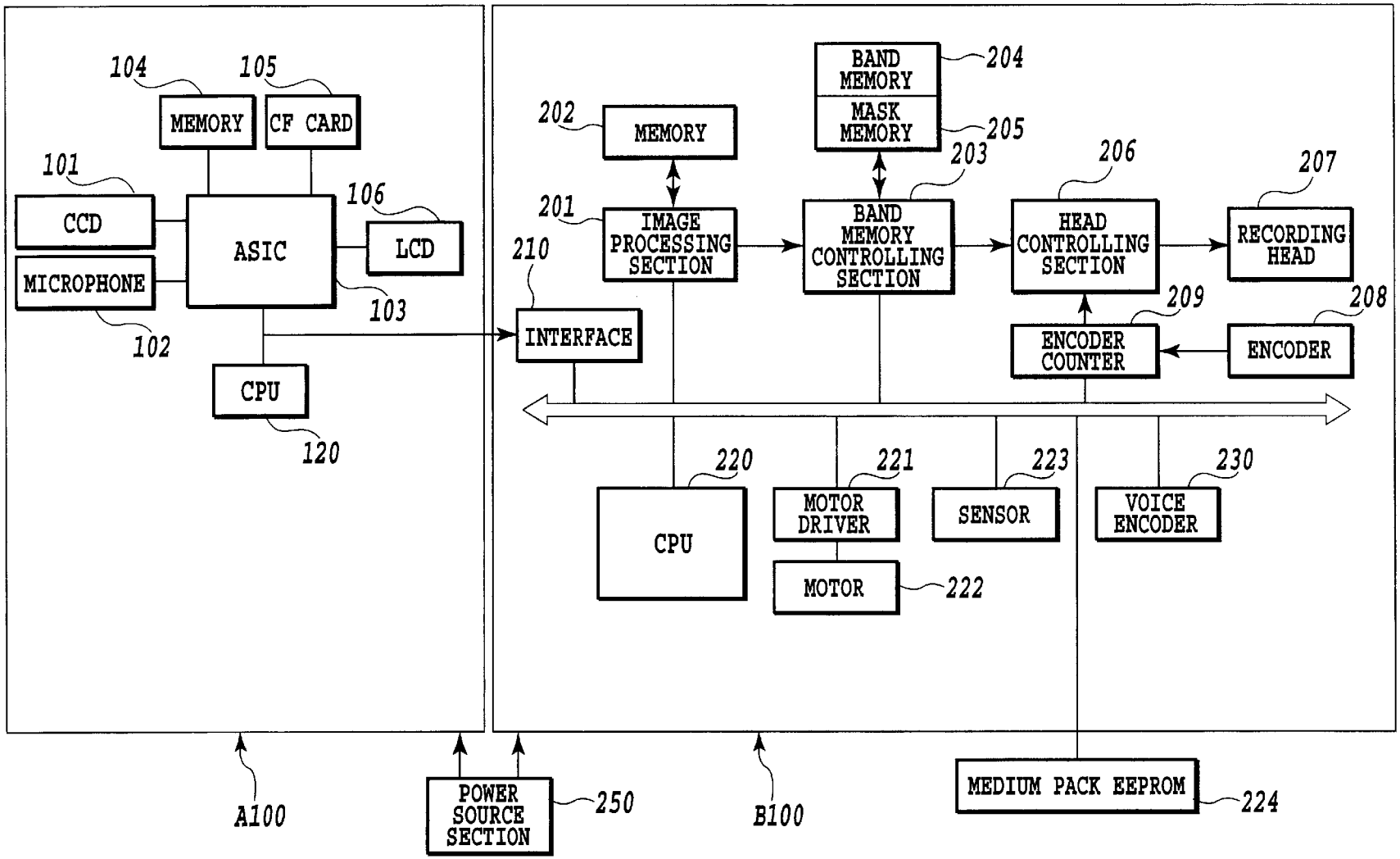
FIG. 12 is a block schematic diagram of the camera section and the printer section of the camera in FIG. 1.

FIG. 12 is a block diagram generally showing the camera section A100 and the printer section B100.

In the camera section A100, 101 denotes a CCD as an image element; 102 denotes a microphone for inputting voice 103 denotes an ASIC (Application Specific IC) for performing various processings; 104 denotes a first memory for temporary storage of an image date and the like; 105 denotes a CF (compact flash) card (corresponding to a "CF card A107") for recording the photographed image; 106 denotes a LCD (corresponding to a "liquid crystal display section A105") which displays the photographed image or a replayed image; and 120 denotes a first CPU for controlling the camera section A100.

In the printer section B100, 210 denotes an interface between the camera section A100 and the printer section B100; 201 denotes an image processing section (including a binary processing section for binarizing an image); 202 denotes a second memory to be used in performing the image processing; 203 denotes a band memory controlling section; 204 denotes a band memory; 205 denotes a mask memory; 206 denotes a head controlling section; 207 denotes a recording head (corresponding to the "recording head B120"); 208 denotes an encoder (corresponding to the "encoder sensor B131"); 209 denotes an encoder counter; 220 denotes a second CPU for controlling the printer section B100; 221 denotes motor drivers; 222 denotes motors (corresponding to the "motors M001, M002, M003 and M004"); 223 denotes sensors (including the "HP sensors B134, B321 and B322"); 224 denotes an EEPROM contained in the medium pack C100; 230 denotes a voice encoder section and 250 denotes a power source section for supplying electric power to the entire device (corresponding to the "battery A108").

Figure 13:
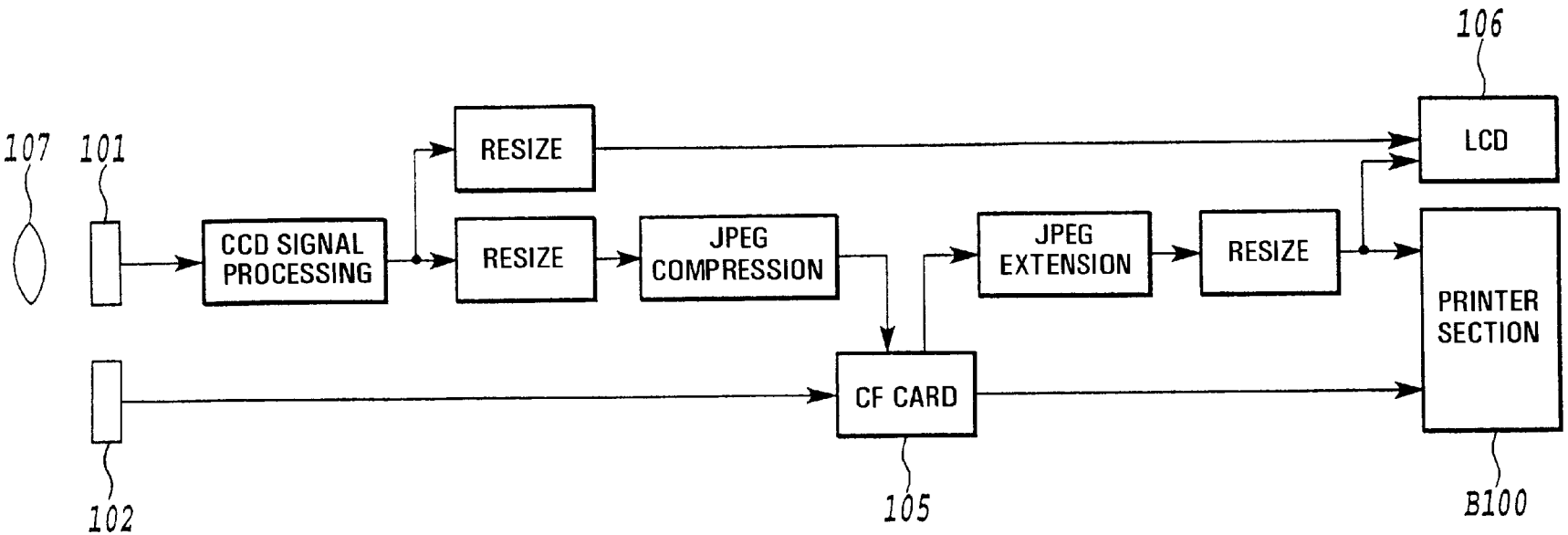
FIG. 13 is a schematic diagram of a signal processing performed in the camera section in FIG. 12.

FIG. 13 is a schematic diagram showing signal processing in the camera section A100. In a photographing mode, an image photographed by the CCD 101 through a lens 107 is signal-processed (CCD signal processing) by ASIC 103 and then is converted to YUV intensity with two color-different signal. Further, the photographed image is resized to a predetermined resolution and recorded on a CF card 105 using a compression method by JPEG, for example. Also, a voice is input through a microphone 102 and stored in the CF card 105 through the ASIC 103. A recording of the voice can be performed in such manner recording at the same time of photographing, or after photographing, a so called after-recording. In a replay mode, the JPEG image is read out from the CF card 105, extended by the JPEG through the ASIC 103 and further resized to be a resolution for displaying, thereby being displayed on the LCD 106.

Figure 14:
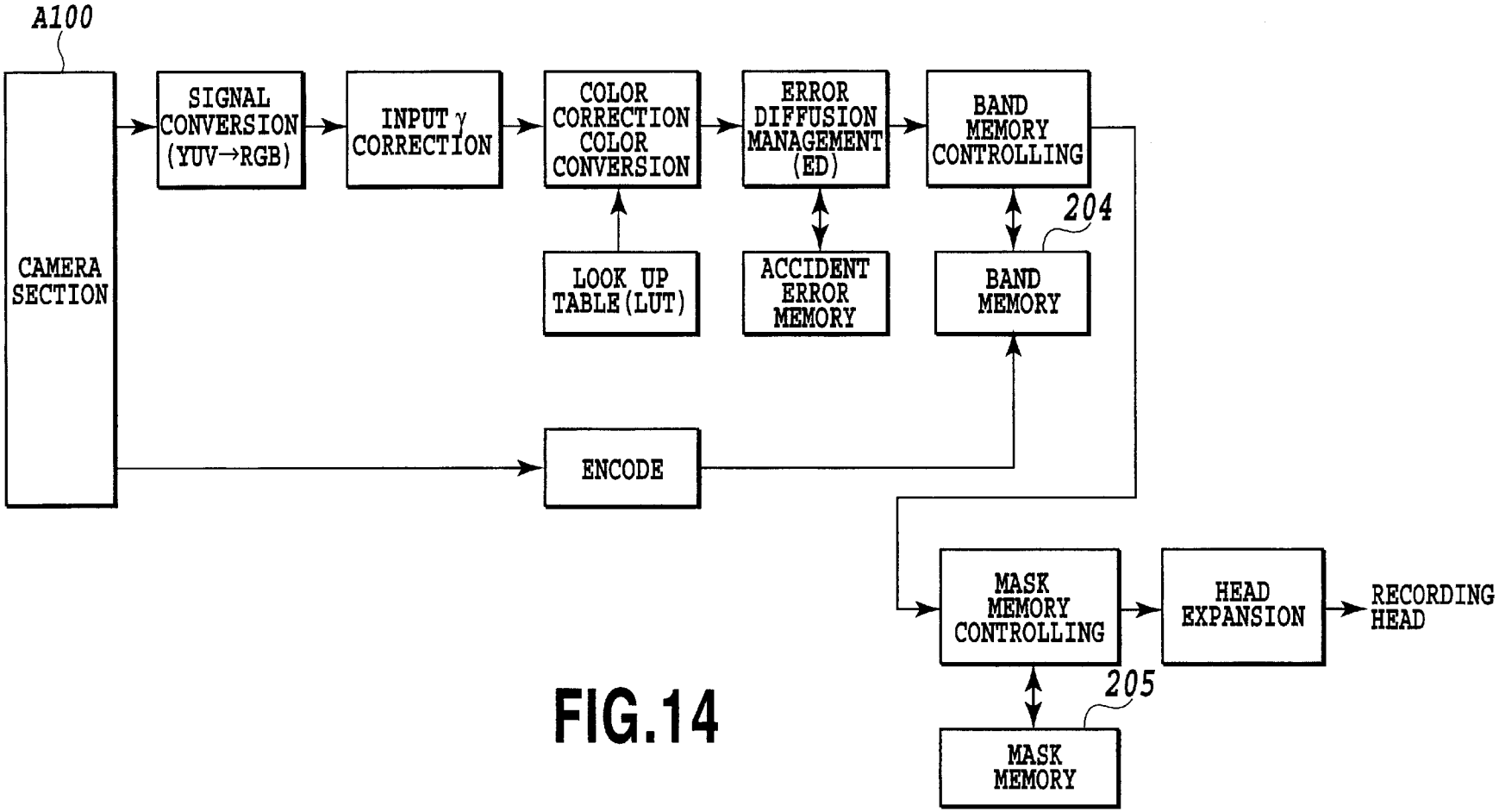
FIG. 14 is a schematic diagram of a signal processing performed in the printer section in FIG. 12.

FIG. 14 is a schematic diagram showing a signal processing performed in the printer section B100.

An image replayed on the camera section A100, that is the image being read out from the CF card 105, is extended by the JPEG as shown in FIG. 13 to resize a resolution to a suitable size for printing. Then, the resized image data (YUV signal), through an interface section 210, is transferred to the printer section B100. As shown in FIG. 14, the printer section B100 performs an image processing of an image data transferred from the camera section A100 by an image processing section 201, thereby performing a conversion of the image data to a RGB signal, an input γ correction in accordance with the features of a camera, a color correction and a color conversion using a look up table (LUT), and a conversion to a binarized signal for printing. When performing the binarizing processing, in order to perform an error diffusion (ED), a second memory 202 is utilized as an error memory. In the case of the present embodiment, though a binarizing processing section in the image processing section 201 performs the error diffusion processing, other processing may be performed, such as a binarizing processing using a dither pattern. The binarized printing data is stored temporarily in the band memory 204 by a band memory controlling section 203. An encoder pulse from the encoder 208 enters into the encoder counter 209 of the printer section B100 every time the carriage B104 carrying the recording head 207 and the encoder 208 moves a certain distance. Then, in sync with this encoder pulse, a printing data is read out from the band memory 204 and the mask memory 205, and, based on thus obtained printing data, the head controlling section 206 controls the recording head 207 to perform a recording.

A band memory shown in FIG. 14 is explained as below.

A plurality of nozzles in the recording head 207, for example, is formed in array so as to achieve a density of 1200 dpi (dots/inch). For recording the image by using such recording head 207, upon performing one scanning by the carriage, it is preferred to previously prepare recording data (recording data corresponding to one scanning) corresponding to the number of nozzles in the sub-scanning direction (hereinafter, also referred to as a "column (Y direction)") and recording data corresponding to the recording area in the scanning direction (hereinafter, also referred to as a "row (X direction)"), respectively. The recording data is created in the image processing section 201 and then is temporarily stored in the band memory 204 by the band memory controlling section 203. After the recording data corresponding to one scan is stored in the band memory 204, the carriage is scanned in the main scanning direction. In so doing, an encoder pulse input by the encoder 208 is counted by the encoder counter 209 and, in accordance with this encoder pulse, recording data is read out from the band memory 204. Then, on the basis of the image data, ink droplets are ejected from the recording head 207. In the case that a bidirectional recording system wherein an image is recorded upon outward scanning and homeward scanning (outward recording and homeward recording) of the recording head 207 is employed, the image data is read out from the band memory 204 depending on the scanning direction of the recording head 207. For example, an address of the image data read out from the band memory 204 is increased sequentially when the outward recording is performed, while an address read out from the band memory 204 is decreased sequentially when the homeward scanning is performed.

In a practical sense, a writing of an image data (C, M and Y) created by the image processing section 201 into the band memory 204 and a subsequent preparation of the image data corresponding to one band enable a scanning of the recording head 207. Then, the image data is read out from the band memory 204 subsequent to a scan of the recording head 207, so that the recording head 207 records the image on the basis of the image data. During the recording operation, image data to be recorded next is created at the image processing section 201, and thus created image data is written into an area of the band memory 204 corresponding to a recording position.

As has been stated above, the band memory controlling is carried out in such manner that a writing operation in which recording data (C, M, Y) created by the image processing section 201 is written into the band memory 204 and a reading operation for transferring the recording data (C, M, Y) to the head controlling section 206 in accordance with a scanning movement of the carriage are changed over.

A mask memory controlling operation illustrated in FIG. 14 is explained below.

This mask memory controlling operation is required when a multipass recording system is employed. In using the multipass recording system, the recording image corresponding to one line which has a width corresponding to a length of the nozzle array of the recording head 207 is divided into a plurality of scanning passes of the recording head 207 to record. That is, the conveying amount of the printing medium to be intermittently carried in the sub-scanning direction is made to be 1/N of a length of the nozzle array. For example, when N=2, a recording image corresponding to one line is divided into two scans to record (two-pass recording), and when N=4, a recording image corresponding to one line is divided into four scans to record (four-pass recording). In similar fashion, when N=8, it becomes eight-pass recording, and when N=16, it becomes sixteen-pass recording. Therefor, the recording image corresponding to one line will be completed by a plurality of scans of the recording head 207.

Practically, mask data for assigning the image data to a plurality of scans of the recording head 207 is stored in the mask memory 205, and then based on a conjunction (AND) data between the mask data and the image data, the recording head 207 ejects inks to record the image.

Also, in FIG. 14, voice data stored in the CF card 105, like the image data, is transferred to the printer section B100 through an interface 210 by the ASIC 102. The voice data transferred to the printer section B100 is encoded at the voice encoder 230 and then recorded with the image to be printed as code data. When there is no necessity to input voice data into a printing image, or when printing an image without voice data, of course, the encoded voice data is not printed, only the image is printed.

In the present embodiment, the present invention has been explained as a printer built-in camera integral with a camera section A100 and printer section B100. However, it would be possible to make each of the camera section A100 and the printer section B100 a separate device and to form in a similar manner as a structure in which those devices are connected to each other by the interface 210 to realize a similar function.

Figure 15:
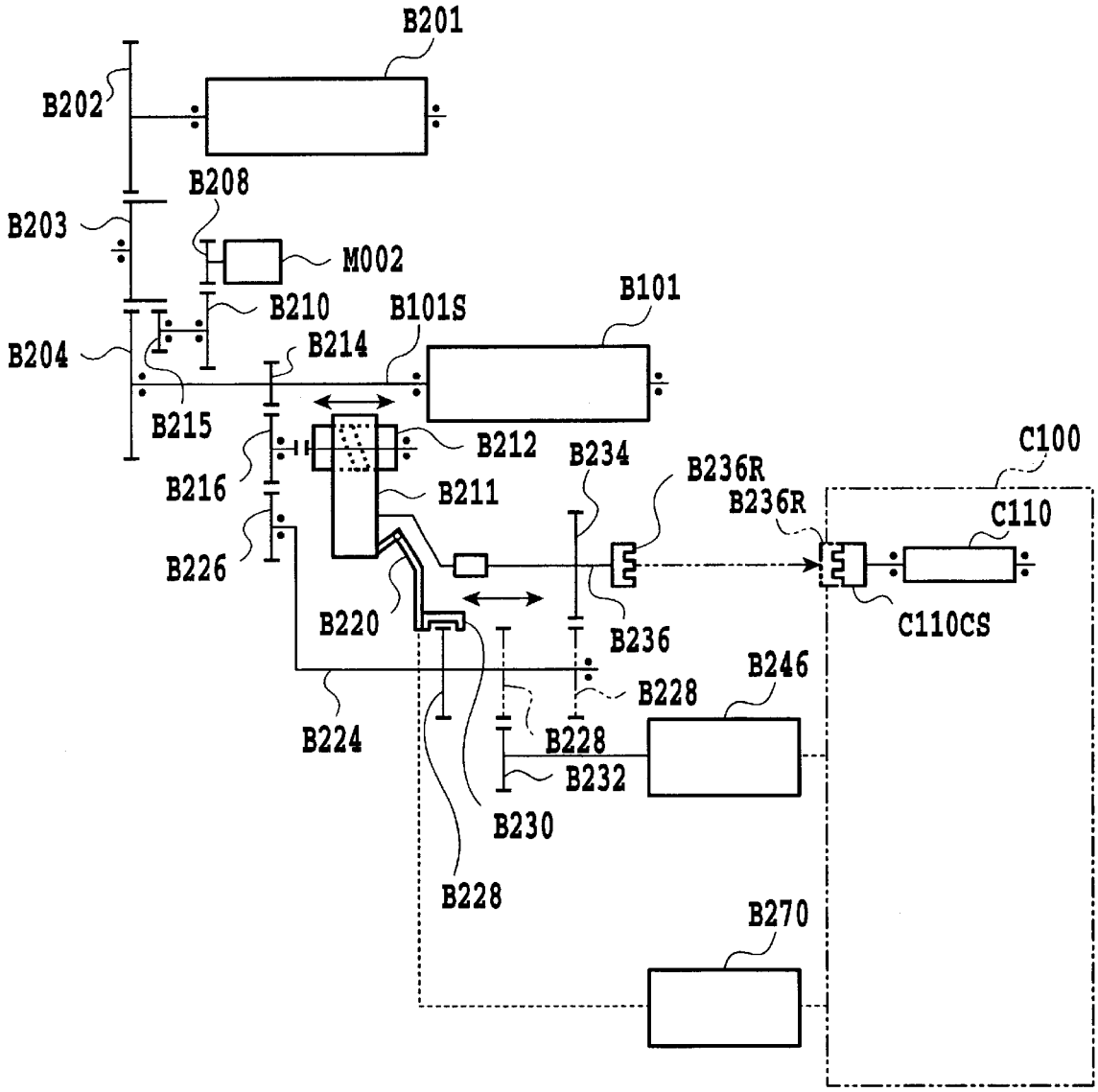
FIG. 15 is a diagrammatic illustration of a power transmission path showing a power transmission path in one embodiment of a printing apparatus with a sheet feeding device according to the present invention, together with a medium pack.

FIG. 15 shows an overall construction of a power transmission path for transmitting a driving force from a feeding motor M002 in the foregoing "printing medium feeding system", together with a medium pack C100.

Driving power of the feeding motor M002 is transmitted to the foregoing junction gear B203 via a pinion gear B208 rigidly secured on an output shaft of the feeding motor M002, a gear B210 rotational moveably supported on a chassis B323 and a gear B215, as shown in FIG. 15. Accordingly, by a rotational force transmitted via a paper delivering roller gear B202 and an LF roller gear B204, a paper delivering roller B201 and the roller B101 are driven to rotate in synchronism with each other. Namely, a printing medium C104 is fed by the paper delivering roller B201 and the LF roller B101 during printing.

It should be noted that the feeding motor M002 is a stepping motor, for example, and is taken as a common drive source for operating the LF roller B101 as described later, paper feeding operation in the medium pack C100, a platen head link mechanism portion B270 and a locking mechanism B246.

Accordingly, a gear type speed reduction mechanism portion is formed with the pinion gear B208, the gear B210, the gear B215, the junction gear B203 and LF roller gear B204, or the junction gear B203 and a paper delivering roller gear B202, respectively, as described later.

Figure 16:
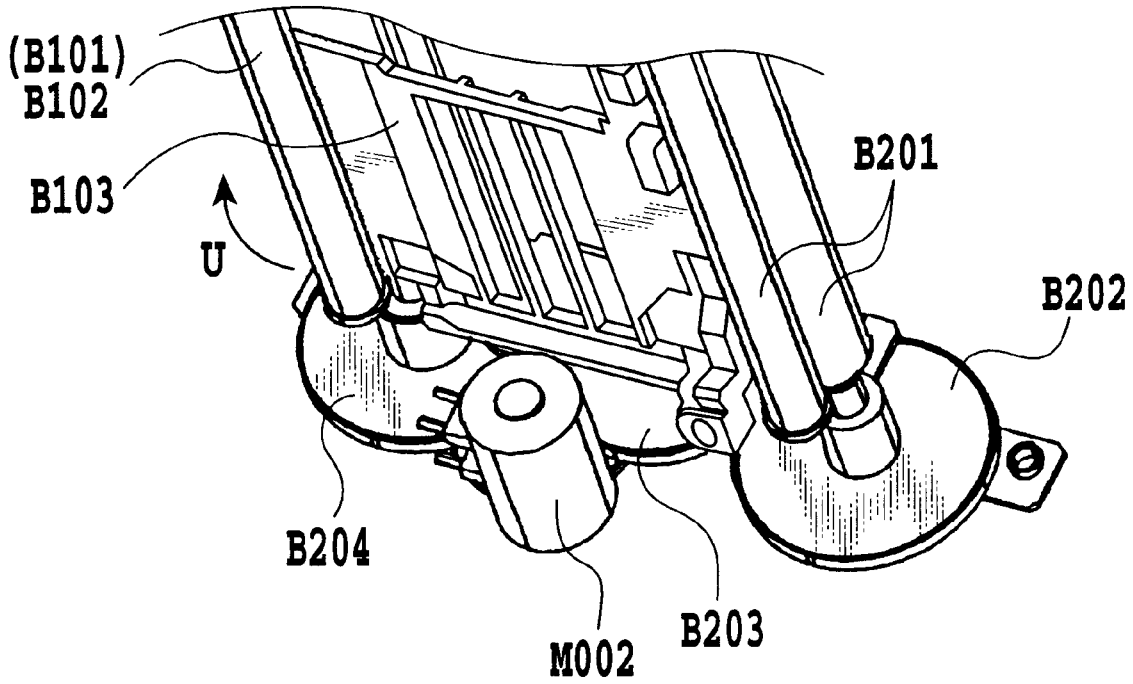
FIG. 16 is a perspective view showing a speed reduction mechanism in the embodiment shown in FIG. 15 together with a feeding motor.
Figure 17:
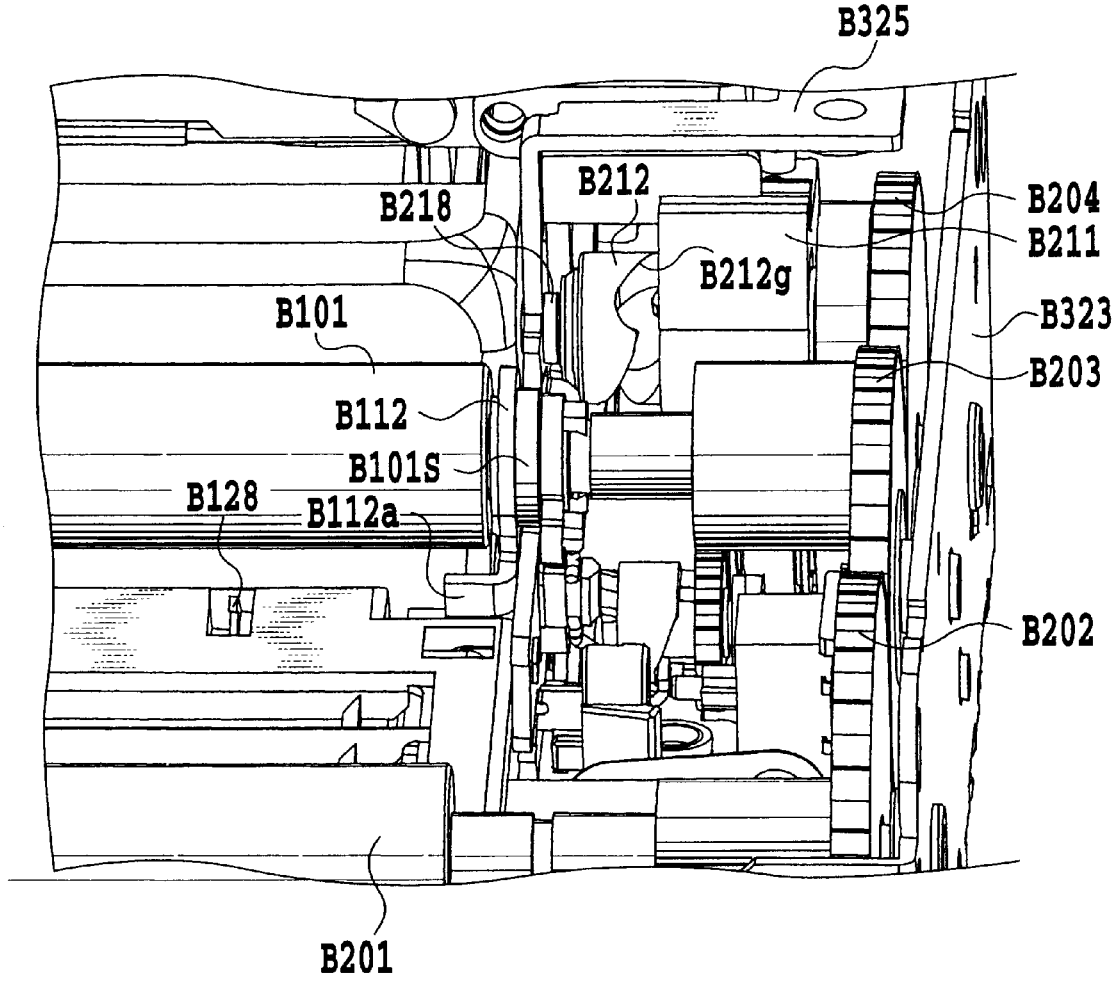
FIG. 17 is a perspective view showing the speed reduction mechanism and a switching mechanism in the embodiment shown in FIG. 15 together with an LF roller and a part of a paper delivering roller.

Driving force to be transmitted to the junction gear B203 is transmitted to the foregoing paper delivering roller gear B202 and the LF roller gear B204 meshing with the junction gear B203, as shown in FIGS. 16 and 17.

Both ends of the roller shaft B101S supporting the LF roller B101 connected to the LF roller gear B204 are rotational moveably supported by bearing portions of the support members B325 arranged in opposition on inner sides of a chassis B323 as shown FIG. 17.

Between both end portions of the LF roller B101 and the bearing portions of the support members B325, thin plate form shaped like thin sheet roller holding arms B112 are arranged, respectively.

One of the roller supporting arms B112 is rotational moveably supported by engaging a through hole thereof with the roller shaft B101S. The other roller supporting arm B112 is also rotational moveably supported by engaging through a hole thereof with the roller shaft B101S. On one end of a pair of roller supporting arms B112, both ends of the foregoing LF pinch roller B102 are pinched for rotation respectively, as shown in FIG. 16.

As shown in FIG. 17, one of roller supporting arms B112 has bent portion B112*a* at one portion on the outer peripheral edge portion. The bent portion B112*a* is formed at an intermediate portion between the LF pinch roller B102 and the LF roller B101. Upon loading of the medium pack C100, the bent portion B112*a* is pushed toward a direction opposite a direction shown by arrow U in FIG. 16 through the engaging claw portion of the pack base on the medium pack C100 as above. On the other hand, the other roller holding arm is biased in the direction shown by arrow U in FIG. 16 by a toggle mechanism which is eliminated from illustration.

Accordingly, the LF pinch roller B102 and the other roller supporting arm B112 are held in stand-by position so as to permit an ink supply/waste liquid collecting portion to pass the lower portion thereof in a pack base of the medium pack C100 to be loaded, while the medium pack C100 is not yet loaded in the printer portion B100.

On the other hand, when the medium pack C100 is loaded in the printer portion B100, an engaging claw portion thereof is contacted with the bent portion B112*a* of the roller supporting arm B112, and thereafter, the LF pinch roller B102 and the roller supporting arms B112 are driven to rotate in counterclockwise direction against biasing force of the toggle mechanism. As a result, the LF pinch roller B102 is received within an arc portion of the pack base and restricts movement of the pack base. Then, when the paper feeding roller C110 in the medium pack C100 is driven to rotate moveably, the printing medium C104 located at the closest position to a pack base C112 is separated to be delivered by a separation claw which is eliminated from illustration, and pinched between the LF roller B101 and the LF pinch roller B102 to be fed toward the paper delivering roller B201.

On the other hand, when the medium pack C100 is removed or unloaded from the printer portion B100, the arc portion of the pack base is drawn in a direction opposite the loading direction. Then, the LF pinch roller B102 and the roller supporting arms B112 are driven to rotate moveably in a clockwise direction to be returned to a stand-by position by the biasing force of the toggle mechanism as above.

Below the LF pinch roller B102 and the LF roller B101, a sheet edge sensor B128 for detecting a leading end in the feeding direction of the printing medium fed from the medium pack C100 reaching a predetermined position and supplying an edge detection output signal to a second CPU 220 as above, is provided as shown in FIG. 17.

On the foregoing roller shaft B101S, the gear B214 is secured between the LF roller gear B204 and the end of the LF roller B101 as shown in FIG. 15. The gear B214 is meshed with a switching gear B216 provided on a cam shaft B218 arranged in opposition to the roller shaft B101S.

The cam shaft B218 is supported rotational moveably and has a switching cam B212. On the outer peripheral portion of the switching cam B212, a predetermined cam groove B212*g* is formed along the entire circumference in the circumferential direction, as shown in FIG. 17. The cam groove B212*g* forms a track corresponding to a predetermined cam curve. To the cam groove B212*g*, a guide pin of the switching slider B211 is engaged. The switching slider B211 is slidably supported by slidably guiding a guide pin thereof with the cam groove B212*g*. On the other hand, the switching arm B220 which will be discussed later, is contacted with the end of the switching slider B211.

The end of the cam shaft B218 and the switching gear B216 are connected via a clutch spring which is eliminated from illustration. The clutch spring goes into a freewheeling condition relative to the end portion of the cam shaft B218 when the switching gear B216 is rotated in forward direction. On the other hand, when the switching gear B216 is driven to rotate in reverse direction, the clutch spring is contracted in the radius direction relative to the end portion of the cam shaft B218 to establish connection. Accordingly, when the switching gear B216 is rotated in the forward direction, rotational force from the switching gear B216 is not transmitted to the end portion of the cam shaft B218, or when the switching gear B216 is rotated in reverse direction, rotational force from the switching gear B216 is transmitted to the end portion of the cam shaft B218.

As shown in FIG. 15, the switching gear B216 is meshed with the drive gear B226 secured at the one end portion of the slide shaft B224. At the slide shaft B224, the slide gear B228 is provided for sliding along its axis. The slide gear B228 is held by a slide gear holder B230. The slide gear holder B230 comes in contact with the switching arm B220.

The slide gear holder B230 and the slide gear B228 are selectively arranged at a predetermined first position, second position and third position depending upon displacement of the switching slider B211 and the switching arm B220. Namely, the first position is a condition where the switching slider B211 is arranged at the predetermined home position and the slide gear holder B230 is arranged at the initial position. The second position is a condition where the switching slider B211 is moved by a predetermined amount and the slide gear B228 is meshed with the drive gear B232 of a lock mechanism which will be discussed later. The third position is a condition that when the switching slider B211 is moved by a predetermined amount and stopped, the switching slider B211 meshes with the drive gear B234 provided on the ratchet support shaft B236 which will be discussed later.

A switching arm B220 shaped like a rectangle is rotational moveably supported by inserting a support shaft into a through hole formed at one end. Both ends of the support shaft are inserted into through holes of a bracket member secured on the support member B325 and caught together. At the support shaft, a return spring biasing the switching arm B220 in one direction is provided.

On the switching arm B220, a connecting shaft engaged with an engaged portion of the slide gear holder B230 is provided. Accordingly, the slide gear holder B230 is, moved to a predetermined position via the switching arm B220 against the biasing force of the return spring depending upon movement of the switching slider B211 associating with the slide gear B228.

On the other hand, on the switching slider B211, a pushing member for pushing the ratchet support shaft B236 in the axial direction, is secured.

The ratchet support shaft B236 having D-shaped cross section, is supported at a gear housing supported on the support member B325, in axially movable and rotatable fashion. On the other end of the ratchet support shaft B236, a clutch claw portion B236R selectively connected with a clutch shaft portion in the paper feeding roller C110 of the medium pack C100, is formed. Between one end of the ratchet support shaft B236 and a drive gear B234 arranged on the ratchet support shaft B236, a return spring which is eliminated from illustration, is provided. Accordingly, the ratchet support shaft B236 is released relative to the clutch shaft portion C110CS in the paper feeding roller C110, and thereafter returned to the initial position by a biasing force of the return spring. It should be noted that drive gear B234 has a D shaped through hole, into which the ratchet support shaft B236 is inserted, whereby the position of which is restricted with respect to the axial direction in the gear housing.

The drive gear B232 for transmitting the rotational force from the slide gear B228 to the locking mechanism B246 is rotational moveably arranged below the switching cam B212. The locking mechanism B246 is constructed with a cam member secured to the connection shaft having the drive gear B232 and a locking piece which is locked according to sway by rotation of the cam member to be placed in locking condition and unlocking condition. When the locking mechanism B246 is placed in locking condition, the locking piece is engaged with a recessed portion of the medium pack C100 set forth above. On the other hand, when the locking mechanism B246 is placed in unlocking condition, the locking piece is placed under conditions of disengagement from the recessed portion of the medium pack C100.

Furthermore, the other end of the switching arm B220 is engaged with one end of the link member in the platen head link mechanism portion B270.

The platen head link mechanism portion B270 is constructed with the switching arm B220 swayed by the foregoing switching slider B211, an arm member rotational moveably supporting a platen head B213 shown in FIG. 9 via a fixing pin and a link member lifted up and down the proximal end portion of the arm member depending upon swaying motion of the switching arm B220 arranged between the other end of the switching arm B220 and the proximal end portion of the arm member.

In the speed reduction mechanism portion constructed with a pinion gear B208, the gear B210, the gear B215, the junction gear B203 and the LF roller gear B204, data of each gear is set as shown in FIG. 20.

It should be noted that, in FIG. 20, signs A, B-1, B-2, C and D respectively correspond to the pinion gear B208, the gear B210, the gear B215, the junction gear B203 and LF roller gear B204. The pinion gear B208, the gear B210, the gear B215, junction gear B203 and LF roller gear B204 are respectively formed of metal or plastic material with accuracy class 0 (JGMA), for example. The number "Z" of teeth are, respective, 12, 96, 13, 100, 130, and a module m is set at 0.1.

On the other hand, the number Z of teeth is set on the basis of the feeding amount (677.44 $\mu$m) of the printing medium C104 per one time upon printing so that when the pinion gear B208 is rotated for four turns (1440.00°), the LF roller gear B204 rotates in 18.00°. At this time, the gear B210 and the gear B215 are also rotated through 180.00°, respectively.

In FIG. 20, meshing error standardized value (allowable value) is set at a value obtained from a table of the meshing error standardized value by taking the module and the accuracy class as parameters. "One pitch" means one pitch meshing error and means fluctuation of a center distance during meshing for one pitch. "Total pitch" means total meshing error and means a maximum value of fluctuation of the center distance during one turn of the gear. A run-out amount of each pitch circle is a value calculated by subtracting from the standardized value of meshing error in "total pitch" the standardized value of meshing error in corresponding "one pitch". Eccentricity amount is half of the run-out amount.

Accordingly, as can be seen from FIG. 20, a ratio of eccentricity amounts of the pinion gear B208 (A) and the gear B215 (B-2) is larger than that of the other gear, it is potentially a primary cause of error of feeding amount of the printing medium C104. However, the pinion gear B208 (A) may not be a cause of error of feeding amount of the printing medium C104, since the pinion gear B208 is rotated four turns in one feeding operation.

On the other hand, since the gear B215 (B-2) is rotated through 180° in one feeding operation, respective errors may be caused at the maximum or minimum eccentric position along the radius direction of the tooth space and thus can be a cause of error of feeding amount of the printing medium C104.

The second CPU 220 performs drive control of the LF roller B101 and the paper delivering roller B201 on the basis of the detection output signal from the phase detector B126 which will be explained later, in order to reduce error of feeding amount of the printing medium C104.

Figure 18:
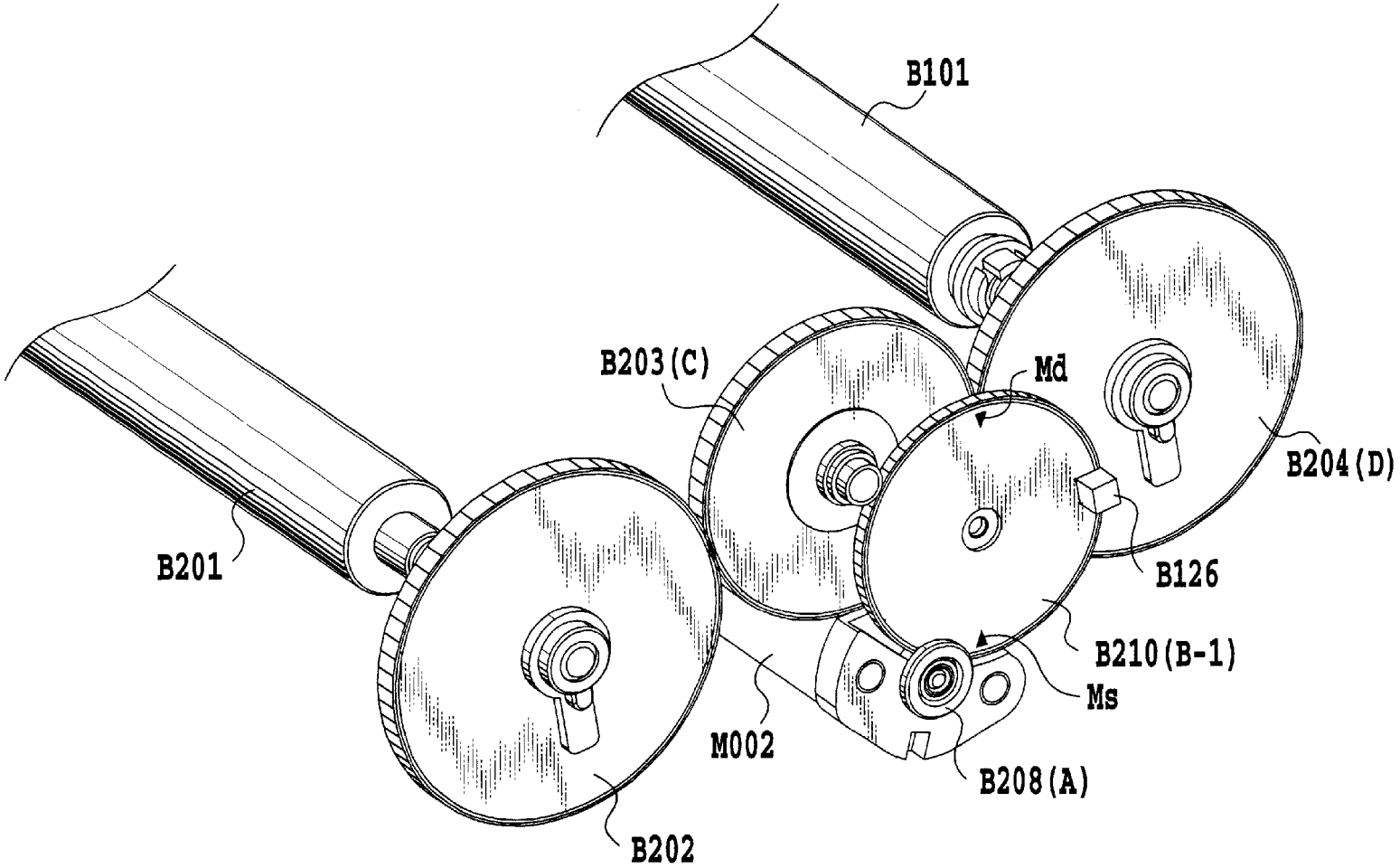
FIG. 18 is an enlarged perspective view showing a gear train that makes up the speed reduction mechanism portion in the embodiment shown in FIG. 16 together with a phase detector.
Figure 19:
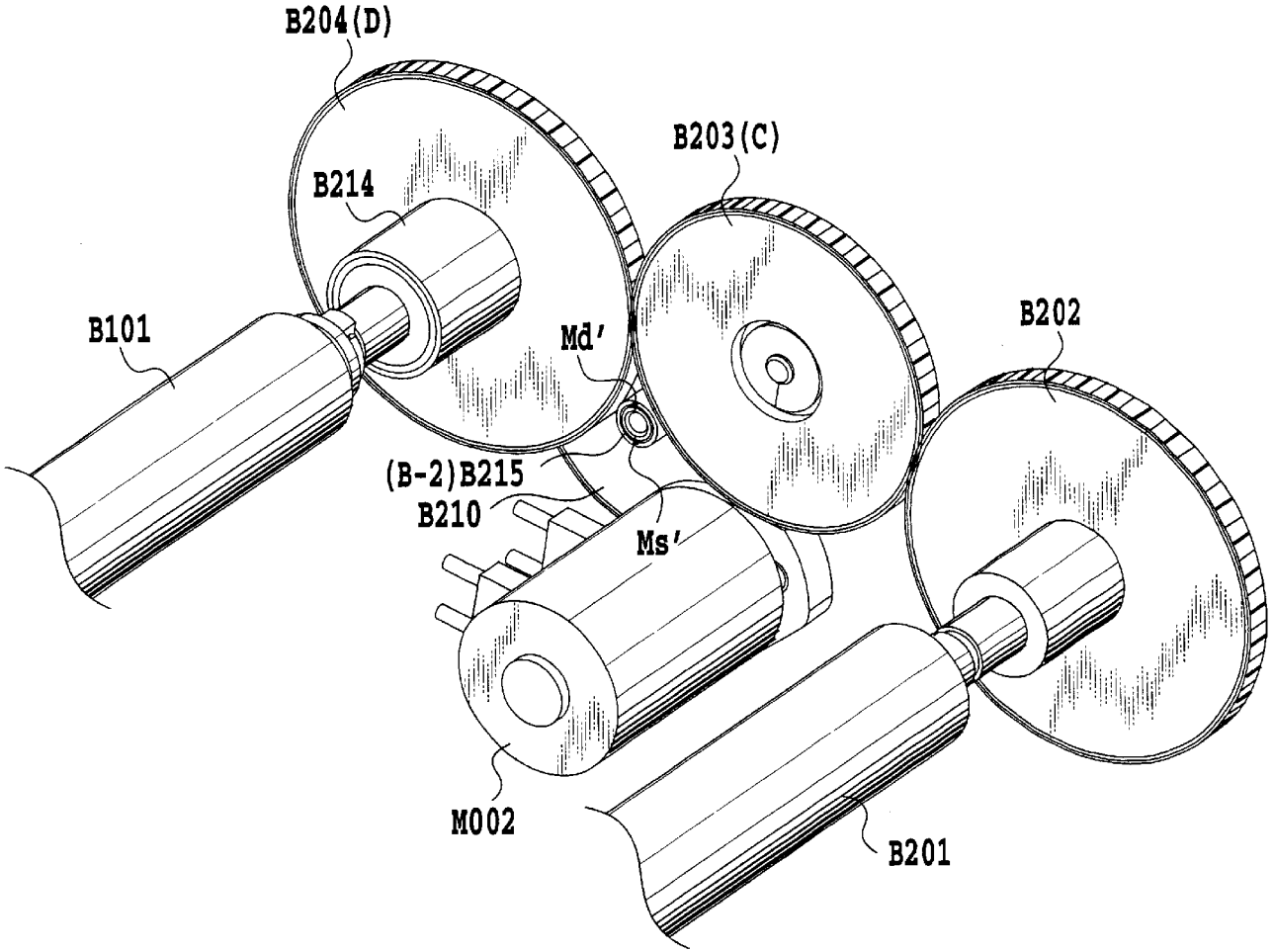
FIG. 19 is an enlarged perspective view showing the gear train that makes up the speed reduction mechanism portion in the embodiment shown in FIG. 16 together with 5 the feeding motor.

As shown in FIGS. 18 and 19, in the foregoing gear type speed reduction mechanism, the phase detector B126 for detecting predetermined marks Md and Ms provided on the surface of the gear B210 is provided on the chassis B323 in opposition to the gear B210. The phase detector B126 is an optical translucent type or reflective type photo-interrupter, for example. When the marks Md and Ms are detected respectively, the phase detector B126 supplies a mark detection output signal to the second CPU 220.

Angular position of the marks Md and Ms are set at angular positions corresponding to marks Md' and Ms' formed on the gear B215, formed on substantially an axial center existing in the axis of the gear B210 shown in FIG. 19. The marks Md' and Ms' in the gear B215 are set points representative of maximum eccentric position and minimum eccentric position along the radial direction relative to predetermined concentric circles in the tooth space corresponding to run-out amount of the pitch circle by preliminary verification through experiments.

It should be noted that the phase detector B126 is constructed for direct detection of the marks Md' and Ms' in the gear B215.

Figure 21:
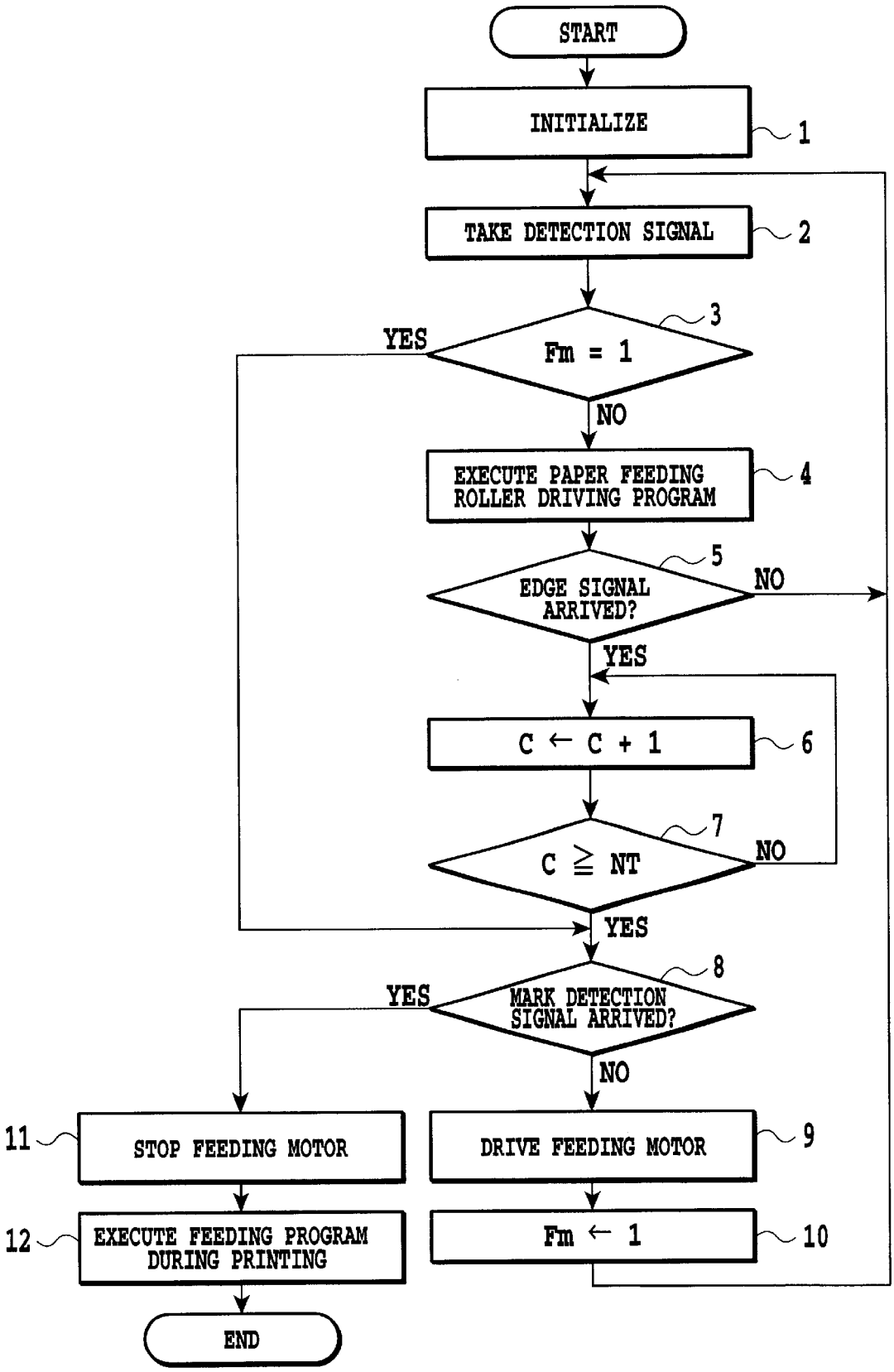
FIG. 21 is a flow chart showing one example of a program to be executed when a second CPU as shown FIG. 12 performs feed control of a printing medium.

Drive control of the LF roller B01 and the paper delivering roller B201 by the second CPU 220 will be explained with reference to a flow chart of FIG. 21 showing one example a program to be executed by the second CPU 220.

In the flowchart shown in FIG. 21, after starting, at step 1, a value of a timer counter is set to zero, and a flag Fm is initialized, i.e., set to zero. Subsequently, at step 2, the foregoing edge detection signal, mark detection signal and so forth are taken. Then, process is advanced to step 3.

At step 3, the second CPU 220 determines whether the flag Fm is set to 1 or not. When it is determined that the flag Fm is not set to one, the paper feeding roller C110 in the medium pack C100 is placed in active state at subsequent step 4 to execute the paper feeding roller drive program for feeding the printing medium C104. Thereafter, process is advanced to step 5.

At step 5, the second CPU 220 determines whether the edge detection signal, indicative of arrival of the printing medium C104 at the predetermined position based on the edge detection signal, has occurred or not. If the edge detection signal has not occurred, the process is returned to step 2. On the other hand, if the edge detection signal occurred, a counter is incremented by adding one to the value C of the counter at subsequent step 6. Then, the process is advanced to step 7. The second CPU 220 determines whether the value C of the counter as incremented is greater than or equal to a predetermined value NT representative of a predetermined period from detection of the leading edge of the printing medium C104 to the time of reaching the predetermined printing position. If the value C of the counter is less than the predetermined value NT, the process returns to step 6. On the other hand, if the value C of the counter is greater than or equal to the predetermined value NT, it is determined whether the mark detection signal indicative of Md or Ms, has arrived or not at subsequent step 8. If such mark detection signal has not arrived, the feeding motor M002 is driven at subsequent step 9 and then the process is advanced to step 10 to set the flag Fm to one. Thereafter, process is returned to step 2 for executing the subsequent processes again as set forth above.

At this time, driving of the feeding motor M002 is performed until the mark detection signal indicative of the mark Md or Ms arrives. Thus, the printing medium C104 is moved.

However, by rotation of the gear B210 through about 180° at the maximum, the mark Md or Ms is detected, it becomes less than one time of feeding distance (677.44 $\mu$m). On the other hand, when an entire surface of the printing medium C104 of the size comparable with a prepaid phone card is a printing surface, the image is formed with extra image outside of the outer circumference of the printing medium C104 to the extent of about 1 mm. Therefore, it may not happen that no image is formed on the end portion of the printing medium C104, and namely no blank area will be left.

On the other hand, when such mark detection signal arrived at step 8, the process is advanced to step 11 to once stop driving of the feeding motor M002 in order to change direction of revolution of the feeding motor M002. Subsequently, at step 12, the feeding program for a printing operation is performed so as to intermittently feed one printing medium C104 depending upon printing operation by the printing head B120. Then, process terminates.

Also, when the flag Fm is set to one as checked at step 3, the process directly jumps to step 8 to execute a process similar to the above.

Figure 24:
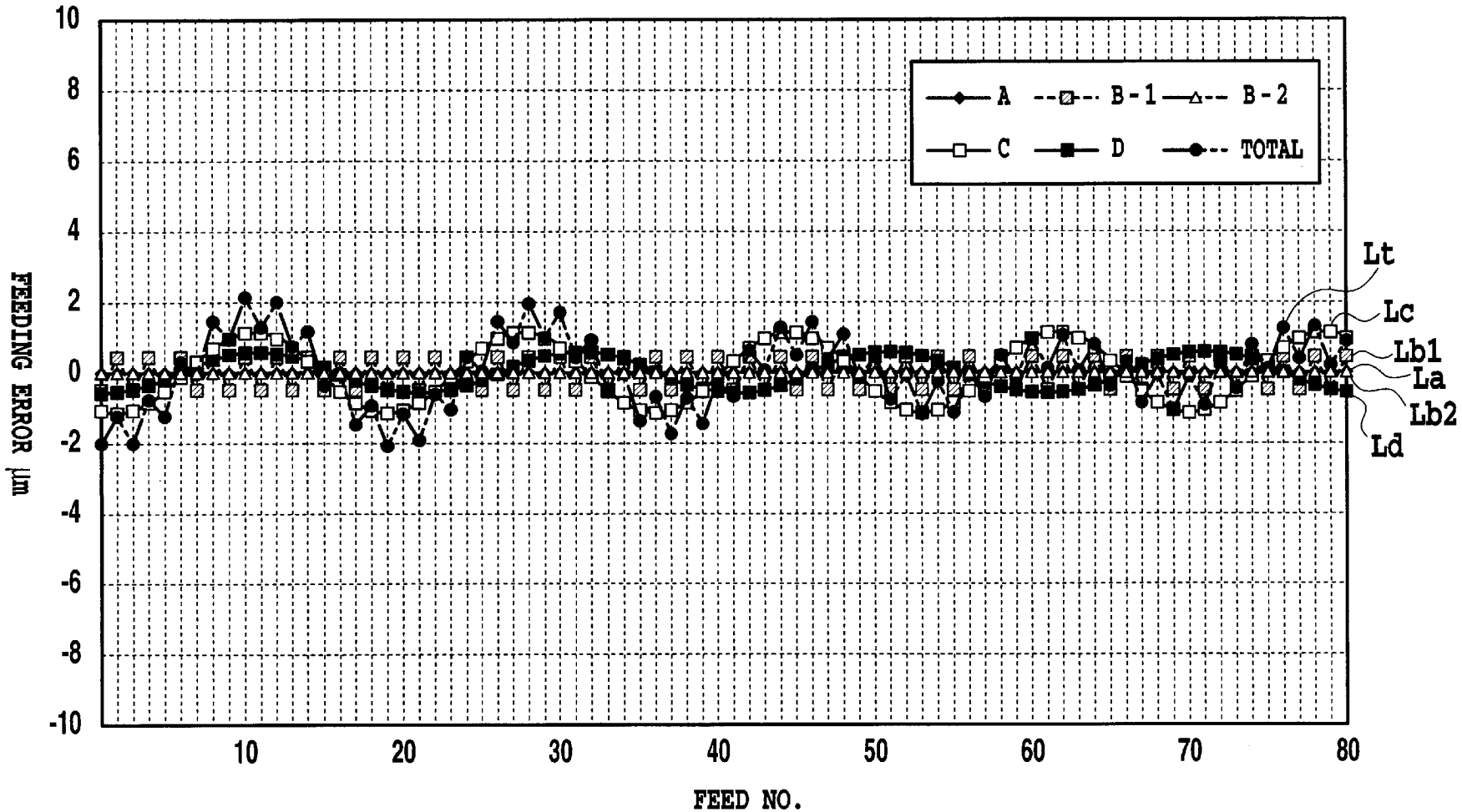
FIG. 24 is a characteristic chart of the feeding error of each gear in the embodiment shown in FIG. 20.

FIG. 24 shows characteristics of feeding error as converted into a deviation of a feeding amount of the printing medium C104 per each time due to run-out of each gear when feeding control is performed for the printing medium on the basis if the mark detection signal indicative of the mark Md or Ms as set forth above, and of total feeding error of the printing medium C104 which could be caused by all gears.

It should be noted that in the shown embodiment and in the embodiment which will be described later, the printing medium C104 is assumed to be fed without sliding relative to the LF roller B101.

In FIG. 24, there are shown characteristics of each gear in the case where feeding is repeated for eighty times, for example, with taking a value (feeding error) as derived by converting machining error of each gear into a deviation of the feeding amount of the printing medium C104 in the vertical axis and the number of times of feeding in the horizontal axis. A sign "+" in the vertical axis means greater with respect to the reference value (ideal value), and the sign "−" means smaller with respect to the reference value.

Characteristic lines La, Lb1, Lb2, Lc and Ld are characteristic lines with respect to the pinion gear B208 (A), the gear B210 (B-1), the gear B215 (B-2), the junction gear B203(C) and the LF roller gear B204 (D). On the other hand, the characteristic line Lt is a characteristic line with respect to a total value (total value of the errors in the feeding amount of the printing medium C104) of the feeding error of all gears at each time of feeding of the printing medium C104.

As shown in FIG. 22, each characteristic line is obtained on the basis of the value ("conversion feeding error") as converted into a deviation of the feeding amount of the printing medium C104 per each time due to run-out of each gear, for example.

FIG. 22 shows each value with respect to the pinion gear B208(A), for example. The "conversion feeding error" is derived on the basis of error of rotational angle obtained by a difference between ideal value of the rotational angle and an actual value of the rotational angle. The actual value of the rotational angle is a value derived on drawing in the case where each gear is rotated. It should be noted that the pinion gear B208 (A) is rotated four turns from starting of feeding to end thereof. Therefore, the pinion gear B208 may never cause "conversion feeding error" on the basis of machining error.

Accordingly, an average value, a maximum value, a minimum value and standard deviation of "conversion feeding error" of each gear is calculated as shown in FIG. 23. As a result, the value in total of the "conversion feeding error" of each gear is in a range between a maximum value +2.13 μm to a minimum value −2.09 μm and a standard deviation becomes 1.02 μm. Therefore, significant fluctuation of the feeding amount of the printing medium C104 based on machining error of the gear B215 (B-2) can be avoided.

Figure 26:
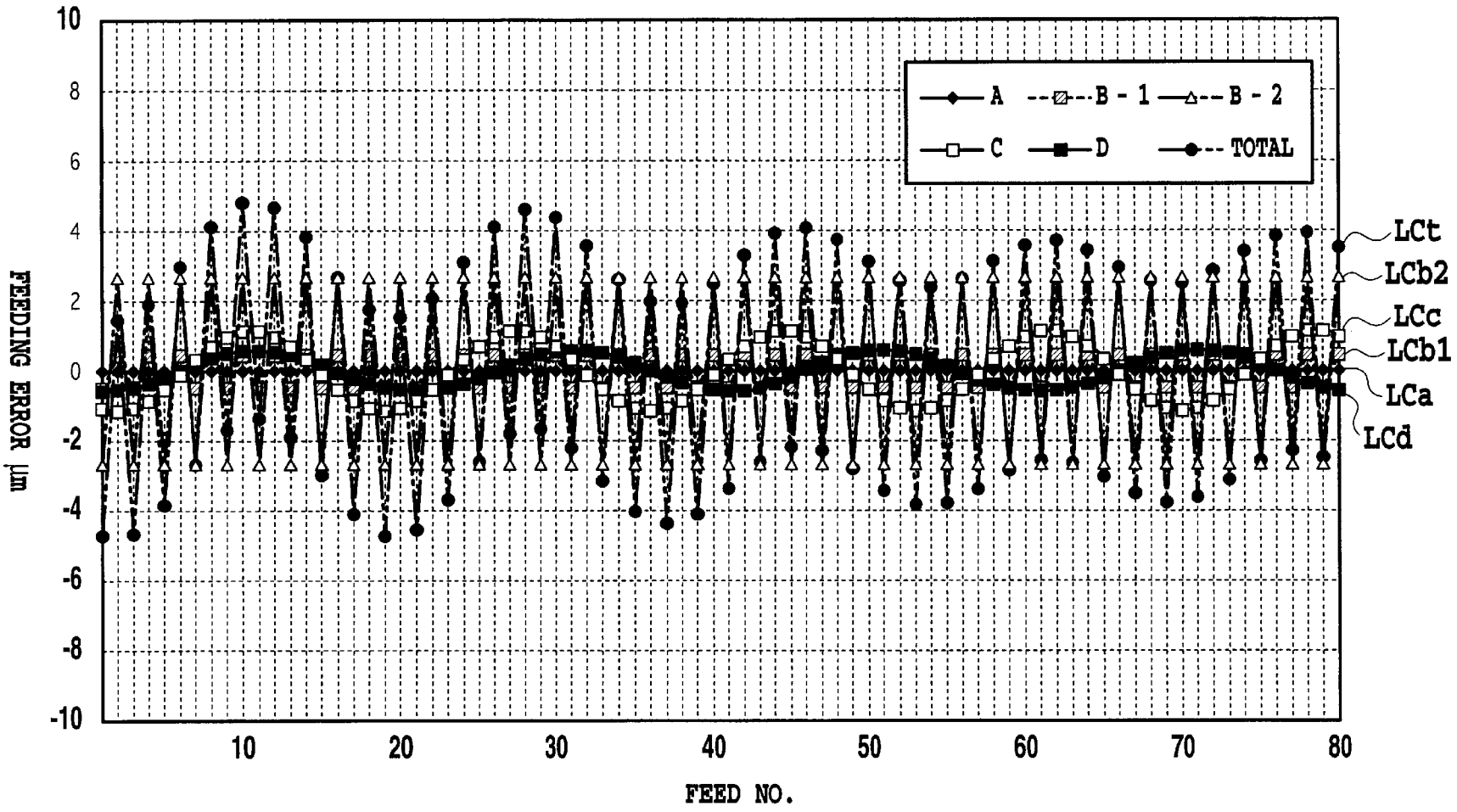
FIG. 26 is a characteristic chart of the feeding error of each gear in the comparative example 1.

On the other hand, FIG. 26 shows characteristics of feeding error as converted into a deviation of the feeding amount of the printing medium C104 per each time caused due to run-out of each gear and of total feeding error of the printing medium C104 possibly caused by all gears incomparative example 1 as an example of the case where control based on the mark detection signal indicative of the mark Md or Ms as set forth above is not rendered. It should be noted that even in the comparative example 1, respective gears shown in FIG. 20 are used.

In FIG. 26, there are shown characteristics of each gear in the case where feeding is repeated for eighty times, for example, with taking a value (feeding error) as derived by converting machining error of each gear into a deviation of the feeding amount of the printing medium C104 in the vertical axis and the number of times of feeding in the horizontal axis similar to FIG. 24. A sign "+" in the vertical axis means greater with respect to the reference value (ideal value), and the sign "−" means smaller with respect to the reference value.

Characteristic lines LCa, LCb1, LCb2, LCc and LCd are characteristic lines with respect to the pinion gear B208 (A), the gear B210 (B-1), the gear B215 (B-2), the junction gear B203 (C) and the LF roller gear B204(D). On the other hand, the characteristic line LCt is a characteristic line with respect to a total value (total value of the errors in the feeding amount of the printing medium C104) of the feeding error of all gears at each time of feeding of the printing medium C104.

Each of characteristic lines LCa, LCb1, LCb2, LCc, LCd and LCt are respectively expressed on the basis of the values of feeding errors of respective gears as shown in FIG. 25.

As can be seen from FIGS. 25 and 26, the feeding error of the pinion gear B208 (B-1) varies within a range from +0.47 μm to −0.47 μm. Since the gear B215 (B-2) is rotated through 180° in one time of feeding, the feeding error of the gear B215 is varied alternately and cyclically within a relatively large range, e.g. +2.66 μm to −2.65 μm in comparison with other gear, due to alternate use of angular range where maximum run-out on the (+) side or (−) side is present. In the shown embodiment, calculation is performed under the premise where feeding error by the pinion gear B208 (B-1) and the gear B215 (B-2) are amplified with each other. The reason is that phase relationship of the off-center direction of both gears is determined by conditions in manufacturing the parts, and it is assumed that the errors are amplified with each other in the worst case.

On the other hand, as shown in FIG. 25, since the junction gear B203(C) and the LF roller gear B204 (D) cause angular displacement only in 21.27° and 18° per one time of feeding, periodic variation per each time is moderate in comparison with the gear B215 (B-2), which varies within a range from +1.16 μm to −1.16 μm and from +0.56 μm to −0.56 μm.

Accordingly, the total "conversion feeding error" in the comparative example 1 is varied with a large range, i.e. from +4.79 μm to −4.74 μm, in comparison with one embodiment of the present invention set forth above, and standard deviation becomes 3.28.

Figure 28:
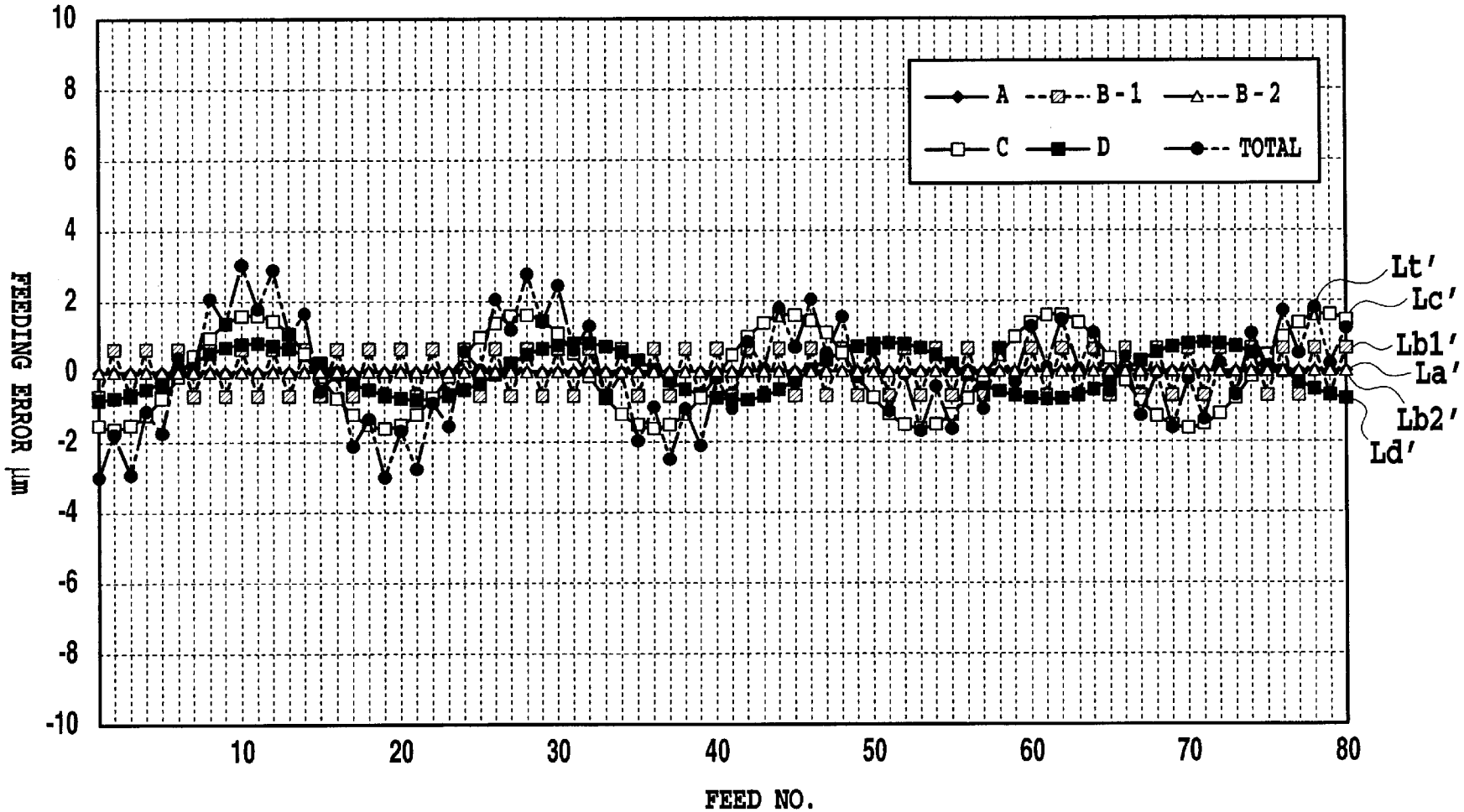
FIG. 28 is a characteristic chart of the feeding error of each gear in an embodiment shown in FIG. 27.

FIG. 28 shows the second embodiment of speed reduction mechanism using a sheet member feeding device according to the present invention.

In FIG. 28, there are shown characteristics of feeding error as converted into deviation of the feeding amount of the printing medium C104 per each time due to run-out of each gear and total feeding error of the printing medium C104 potentially caused by all gears when feed control is performed for the printing medium C104 on the basis of the mark detection signal indicative of the foregoing mark Md or Ms.

Gears to be used are the pinion gear B208 (A), the gear B210 (B-1), the gear B215 (B-2), the junction gear B203 (C) and LF roller gear B204 having data shown in FIG. 20, and accuracy class is 1.

In FIG. 28, there are shown characteristics of each gear in the case where feeding is repeated for eighty times, for example, with taking a value (feeding error) as derived by converting machining error of each gear into a deviation of the feeding amount of the printing medium C104 in the vertical axis and the number of times of feeding in the horizontal axis. A sign "+" in the vertical axis means greater with respect to the reference value (ideal value), and the sign "−" means smaller with respect to the reference value.

Characteristic lines La', Lb1', Lb2', Lc' and Ld' are characteristic lines with respect to the pinion gear B208 (A),the gear B210 (B-1), the gear B215 (B-2), the junction gear B203(C) and the LF roller gear B204 (D). On the other hand, the characteristic line Lt' is a characteristic line with respect to a total value (total value of the errors in the feeding amount of the printing medium C104) of the feeding error of all gears at each time of feeding of the printing medium C104.

Each characteristic line is obtained on the basis of the value ("conversion feeding error") converted into the deviation of the feeding amount of the printing medium C104 per each time due to run-out of each gear, for example.

Each coordinate point in FIG. 28 shows "conversion feeding error" in each time similar to the foregoing example. Calculation method of the "conversion feeding error" is similar to the foregoing embodiment. Namely, each "conversion feeding error" is derived on the basis of an error of rotational angle obtained from a difference between the ideal value of rotational angle and the actual value of the rotational angle. The actual value of the rotational angle is a value derived on drawing in the case where each gear is rotated. It should be noted that the pinion gear B208(A) is rotated for four turns from starting of feeding to end thereof. Therefore, the pinion gear B208 may never cause "conversion feeding error" on the basis of machining error.

Accordingly, an average value, a maximum value, a minimum value and standard deviation of "conversion feeding error" of each gear is calculated as shown in FIG. 27. As a result, the value in total of the "conversion feeding error" of each gear is in a range between a maximum value +3.06 μm to a minimum value −2.99 μm and a standard deviation becomes 1.46 μm. Therefore, significant fluctuation of the feeding amount of the printing medium C104 based on machining error of the gear B215 (B-2) can be avoided.

Figure 30:
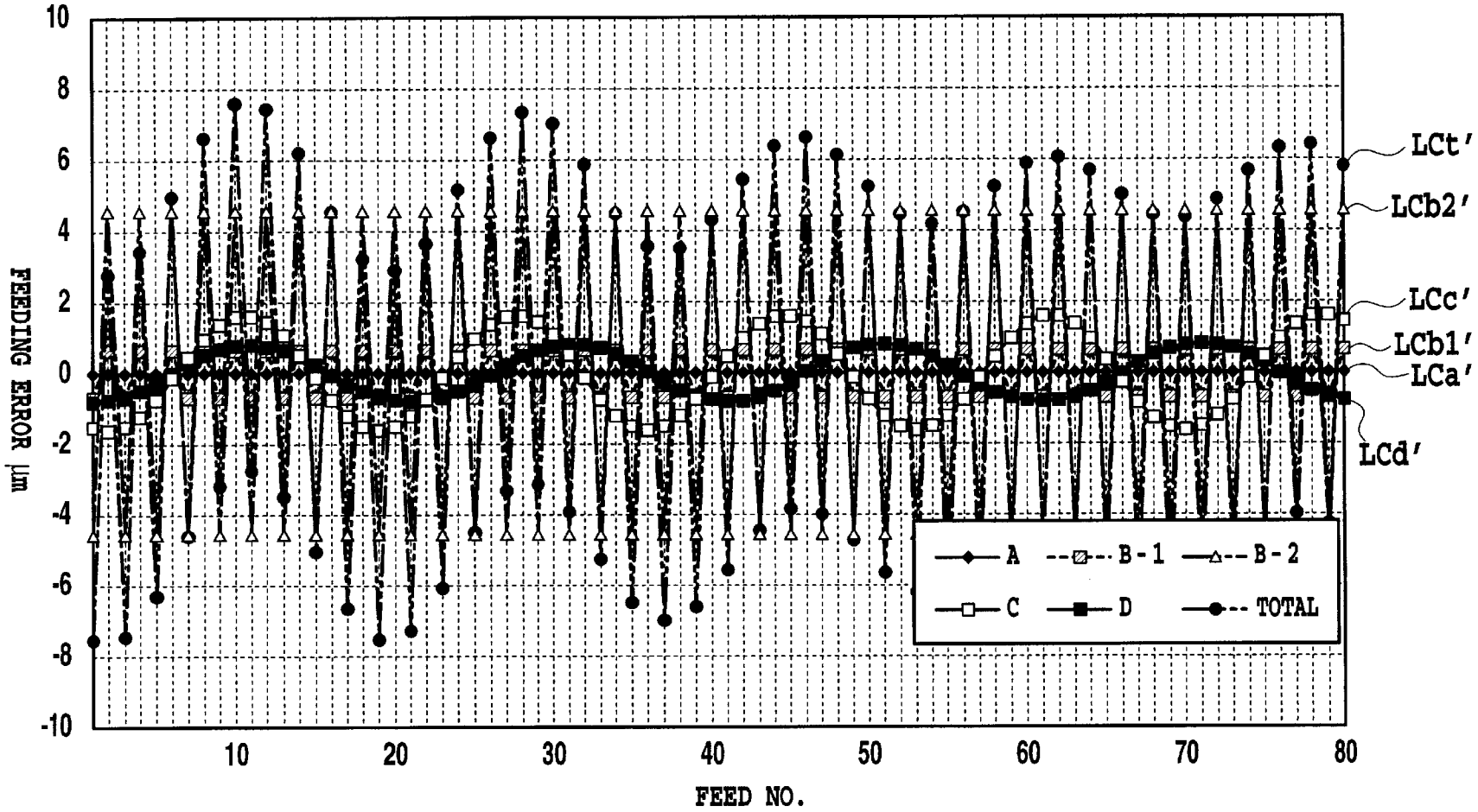
FIG. 30 is a characteristic chart of the feeding error of each gear in the comparative example 2.

On the other hand, FIG. 30 shows characteristics of feeding error as converted into a deviation of the feeding amount of the printing medium C104 per each time caused due to run-out of each gear and of total feeding error of the printing medium C104 possibly caused by all gears in comparative example 2 as an example of the case where control based on the mark detection signal indicative of the mark Md or Ms as set forth above. It should be noted that even in the comparative example 2, respective gears shown in FIG. 27 of accuracy class 1 are used.

FIG. 30 shows characteristics of each gear in the case where feeding is repeated for eighty times, for example, with taking a value (feeding error) as derived by converting machining error of each gear into a deviation of the feeding amount of the printing medium C104 in the vertical axis and the number of times of feeding in the horizontal axis. A sign "+" in the vertical axis means greater with respect to the reference value (ideal value), and the sign "−" means smaller with respect to the reference value.

Characteristic lines LCa', LCb1', LCb2', LCc' and LCd' are characteristic lines with respect to the pinion gear B208 (A), the gear B210 (B-1), the gear B215 (B-2), the junction gear B203 (C) and the LF roller gear B204 (D). On the other hand, the characteristic line LCt' is a characteristic line with respect to a total value (total value of the errors in the feeding amount of the printing medium C104) of the feeding error of all gears at each time of feeding of the printing medium C104.

Each of the characteristic lines LCa', LCb1', LCb2', LCc', LCd' and LCt is respectively expressed on the basis of the values of feeding errors ("conversion feeding error") of respective gears as shown in FIG. 25.

As is clear from FIGS. 29 and 30, the feeding error of the pinion gear B208 (B-1) varies within a range from +0.67 μm to −0.67 μm. Since the gear B215 (B-2) is rotated through 180° in one time of feeding, the feeding error of the gear B215 is varied alternately and cyclically within relatively large range, e.g. +4.55 μm to −4.55 μm in comparison with other gear, due to alternate use of angular range where maximum run-out on the (+) side or (−) side is present. In the shown embodiment, calculation is performed under the premise where feeding error by the pinion gear B208 (B-1) and the gear B215 (B-2) are amplified with each other. The reason is that phase relationship of the off-center direction of both gears is determined by conditions in manufacturing the parts, and it is assumed that the errors are amplified with each other in the worst case. On the other hand, since the junction gear B203 (C) and the LF roller gear B204 (D) cause angular displacement only in 21.27° and 18° per one time of feeding, periodic variation per each time is moderate in comparison with the gear B215 (B-2) to vary within a range from +1.65 μm to −1.66 μm and from +0.82 μm to −0.82 μm.

Accordingly, as shown in FIG. 29, the total "conversion feeding error" in the comparative example 1 is varied with large range, i.e. from +7.61 μm to −7.54 μm, in comparison with the second embodiment of the present invention set forth above, and standard deviation becomes 5.42.

As a result, even in the foregoing second embodiment, in comparison with the case of the comparative example 2 not performing control on the basis of the mark detection signal indicative of the mark Md or Ms, feeding error can be reduced.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A sheet member feeding device comprising:

a first gear transmitting a driving force to a feeding roller for intermittently feeding a sheet member per a predetermined feeding amount;

a second gear having a first mark and a second mark representative of a maximum eccentric position and a minimum eccentric position along a radial direction relative to a predetermined concentric circle in a tooth space, in opposition to each other and directly or indirectly transmitting a driving force to said first gear;

a third gear directly or indirectly transmitting driving force from driving means to said second gear;

detecting means for detecting the first mark and the second mark in said second gear and transmitting a detection output; and a control portion operating said driving means for performing operation for rotating said second gear through 180° between said first mark and said second mark with respect to feeding for a feeding amount of said sheet member for one time, on the basis of the detection output from said detecting means.

2. A sheet member feeding device according to claim 1, wherein said first mark and said second mark are formed with a through hole passing a light beam or a reflecting member reflecting the light beam.

3. A sheet member feeding device according to claim 1, wherein said first mark and said second mark are aligned on a straight line extending an in off-center direction along a radial direction with respect to the predetermined concentric circle in the tooth space.

4. A sheet member feeding device according to claim 2, wherein said detecting means is an optically permeable type or reflection type sensor.

5. A sheet member feeding device according to claim 1, wherein a diameter of said second gear is smaller than a diameter of said third gear or said first gear.

6. A sheet member feeding device according to claim 1, wherein a driving force from said third gear is supplied to a second feeding roller gear supplying driving force to a second feeding roller, via a relay gear provided between said first gear and said second gear.

7. A sheet member feeding device according to claim 1, wherein a speed reduction mechanism portion for said feeding roller of said driving means is formed with said first gear, said second gear and said third gear.

8. A printing apparatus comprising:

a sheet member feeding device comprising:

a first gear transmitting a driving force to a feeding roller for intermittently feeding a sheet member per a predetermined feeding amount;

a second gear having a first mark and a second mark representative of a maximum eccentric position and a minimum eccentric position along a radial direction relative to a predetermined concentric circle in a tooth space, in opposition to each other and directly or indirectly transmitting a driving force to said first gear;

a third gear directly or indirectly transmitting driving force from driving means to said second gear;

detecting means for detecting the first mark and the second mark in said second gear and transmitting a detection output; and a control portion operating said driving means for performing operation for rotating said second gear through 180° between said first mark and said second mark with respect to feeding for a feeding amount of said sheet member for one time, on the basis of the detection output from said detecting means;

a printing portion performing a printing operation on a surface of a sheet member intermittently fed by said sheet member feeding device; and a control portion performing operation control of said printing portion.

9. A printing apparatus according to claim 8, wherein a driving force from said third gear is supplied to a second feeding roller gear, in turn supplying driving force to a second feeding roller, via a relay gear provided between said first gear and said second gear.

10. A printing apparatus according to claim 9, wherein said sheet member is fed by cooperation of said second feeding roller and said feeding roller during a printing operation.

11. A printing apparatus according to claim 8, wherein said printing portion has an electrothermal transducer for heating an ink so as to eject ink toward the surface of said sheet member.

12. An image pick-up apparatus comprising:

an image pick-up mechanism; and a printing apparatus comprising:

a sheet member feeding device comprising:

a first gear transmitting a driving force to a feeding roller for intermittently feeding a sheet member per a predetermined feeding amount;

a second gear having a first mark and a second mark representative of a maximum eccentric position and a minimum eccentric position along a radial direction relative to a predetermined concentric circle in a tooth space, in opposition to each other and directly or indirectly transmitting a driving force to said first gear;

a third gear directly or indirectly transmitting driving force from driving means to said second gear;

detecting means for detecting the first mark and the second mark in said second gear and transmitting a detection output; and a control portion operating said driving means for performing operation for rotating said second gear through 180° between said first mark and said second mark with respect to feeding for a feeding amount of said sheet member for one time, on the basis of the detection output from said detecting means;

a printing portion performing a printing operation on a surface of a sheet member intermittently fed by said sheet member feeding device; and a control portion performing operation control of said printing portion.

* * * * *

UNITED STATES PATENT AND TRADEMARK OFFICE

CERTIFICATE OF CORRECTION

PATENT NO. : 6,609,709 B2
DATED : August 26, 2003
INVENTOR(S) : Keiji Takahashi et al.

It is certified that error appears in the above-identified patent and that said Letters Patent is hereby corrected as shown below:

Column 7,
Lines 28 and 29, “a” should read -- an --.

Column 16,
Line 31, “respective,” should read -- respectively, --.

Column 22,
Line 24, “an in” should read -- in an --.

Signed and Sealed this

Third Day of February, 2004

JON W. DUDAS
*Acting Director of the United States Patent and Trademark Office*